US011214069B2

(12) United States Patent
Reder et al.

(10) Patent No.: US 11,214,069 B2
(45) Date of Patent: Jan. 4, 2022

(54) PRINTING PRESS

(71) Applicant: KOENIG & BAUER AG, Würzburg (DE)

(72) Inventors: Wolfgang Reder, Veitshöchheim (DE); Joachim Keupp, Rimpar (DE); Christian Arnold, Rimpar (DE); Karl Schäfer, Kürnach (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/288,939

(22) PCT Filed: Jan. 31, 2020

(86) PCT No.: PCT/EP2020/052415
§ 371 (c)(1),
(2) Date: Apr. 27, 2021

(87) PCT Pub. No.: WO2020/169321
PCT Pub. Date: Aug. 27, 2020

(65) Prior Publication Data

US 2021/0309012 A1 Oct. 7, 2021

(30) Foreign Application Priority Data

Feb. 22, 2019 (DE) ..... 10 2019 104 579.7

(51) Int. Cl.
*B41J 2/165* (2006.01)

(52) U.S. Cl.
CPC ..... *B41J 2/16552* (2013.01)

(58) Field of Classification Search
CPC ..... B41J 2/16552
See application file for complete search history.

(56) References Cited

U.S. PATENT DOCUMENTS

| | | | |
|---|---|---|---|
| 5,574,485 | A | 11/1996 | Anderson et al. |
| 2012/0212542 | A1 | 8/2012 | Kimura |
| 2012/0249673 | A1 | 10/2012 | Mita |
| 2013/0182035 | A1 | 7/2013 | Ito |
| 2013/0249997 | A1 | 9/2013 | Yokouchi |
| 2014/0373929 | A1 | 12/2014 | Fukada et al. |

(Continued)

FOREIGN PATENT DOCUMENTS

| | | | | |
|---|---|---|---|---|
| DE | 10255827 | A1 | 7/2003 | |
| DE | 102011002727 | A1 | 7/2012 | |
| DE | 102014206994 | A1 * | 10/2015 | ..... B41J 2/16541 |

(Continued)

OTHER PUBLICATIONS

International Search Report of PCT/EP2020/052415 dated May 13, 2020.

*Primary Examiner* — Sharon Polk
(74) *Attorney, Agent, or Firm* — Mattingly & Malur, PC

(57) ABSTRACT

A printing press includes at least one printing unit having at least one nozzle bar with at least two print heads and at least one cleaning device. Each nozzle bar is assigned at least one cleaning device. The at least one cleaning device includes at least one cleaning element. The at least one cleaning element is arranged to be movable in, and counter to a cleaning direction. The at least one cleaning element has at least one fluid infeed opening and at least one fluid discharge and at least one fluid extraction device.

22 Claims, 12 Drawing Sheets

(56) References Cited

U.S. PATENT DOCUMENTS

| | | | |
|---|---|---|---|
| 2016/0144627 | A1 | 5/2016 | Ozaki et al. |
| 2018/0178526 | A1 | 6/2018 | Lela et al. |

FOREIGN PATENT DOCUMENTS

| | | | |
|---|---|---|---|
| DE | 112014003630 | T5 | 4/2016 |
| DE | 102016214356 | A1 | 2/2018 |
| DE | 102016125321 | A1 | 6/2018 |
| JP | 2008062389 | A | 3/2008 |

* cited by examiner

PRINTING PRESS

CROSS-REFERENCE TO RELATED APPLICATIONS

This application is the U.S. national phase, under 35 USC § 371, of PCT/EP2020/052415, filed Jan. 31, 2020; published as WO 2020/169321 A1 on Aug. 27, 2020, and claiming priority to DE 10 2019 104 579.7, filed Feb. 22, 2019, the disclosures of which are expressly incorporated herein by reference in their entireties.

FIELD OF THE INVENTION

The present invention relates to a printing press. The printing press includes at least one printing unit having at least one nozzle bar with at least two print heads and at least one cleaning device. Each nozzle bar is assigned at least one cleaning device. The at least one cleaning device comprises at least one cleaning element.

BACKGROUND OF THE INVENTION

There are a number of available methods for printing onto a printing substrate using a printing press, for example letterpress, gravure, or non-impact printing methods. Non-impact printing methods, such as thermographic methods or the inkjet method in particular, do not use a fixed, physically unchangeable printing forme and are capable of producing different print images on a printing substrate in each print operation, for example. A non-impact printing press typically has at least one image-producing device, in particular at least one printing unit, preferably with at least one print head, preferably an inkjet print head, for example. In the inkjet printing method, individual droplets of a printing fluid are ejected as needed from at least one volume of the print head and are transferred to a printing substrate, producing a printed image on the printing substrate. By actuating a multitude of volumes of the print head individually, different print images are produced, for example, which are individualized and/or personalized, for example, and/or which are produced cost-effectively, for example, particularly in small print runs.

From DE 10 2016 214 356 A1 a printing press that comprises a cleaning device for cleaning at least one print head of a nozzle bar is known.

DE 11 2014 003 630 T5 discloses a cleaning device having a spray nozzle for spraying a cleaning solution onto a gap between two head modules of an inkjet head, and two removal elements configured as wipes for removing the cleaning solution.

DE 10 2016 125 321 A1 discloses a device for cleaning print heads, having at least one spray nozzle, which sprays a cleaning jet at an obtuse angle of incidence onto a nozzle surface of the print head to be cleaned, and a wiper lip, which then wipes the nozzle surface.

From DE 10 2011 002 727 A1, a maintenance unit for cleaning nozzles of a print head of an inkjet printer is known, wherein the maintenance unit comprises a parking station and a cleaning station, and the cleaning station comprises at least one cleaning nozzle and at least one extraction opening.

U.S. Pat. No. 5,574,485 A discloses a maintenance station for cleaning nozzles of an inkjet print head, having a cleaning nozzle, which ejects an ultrasound-excited cleaning liquid onto the respective nozzle to be cleaned, and two vacuum nozzles, which remove the cleaning liquid and the ink dissolved therein.

SUMMARY OF THE INVENTION

The object of the present invention is to create a printing press.

The object is attained by the provision of the at least one cleaning element being arranged to be movable in, and counter to a cleaning direction. The at least one cleaning element has at least one fluid infeed opening and at least one fluid discharge and at least one fluid extraction device.

The advantages to be achieved with the invention are, in particular, that the cleaning device comprises at least one fluid infeed opening and/or at least one fluid discharge and/or at least one fluid extraction means. The cleaning device comprises the at least one fluid infeed opening and/or the at least one fluid discharge and/or the at least one fluid extraction means, with the longitudinal direction of the fluid infeed opening and/or the longitudinal direction of the fluid discharge and/or the longitudinal direction of the fluid extraction means each being positioned parallel to the respective positioning gap to be cleaned. Penetration of a cleaning agent into the positioning gap is thus ensured, for example, and/or cleaning of the respective positioning gap is possible. An intensive cleaning of the positioning gap is thus possible, for example.

Advantageously, two boundary points of a boundary of the at least one fluid extraction means have the greatest possible distance from one another, the minimum length of which is greater than at least one boundary of a relevant exit surface of a relevant print head in a direction that is oriented parallel to the minimum length of the fluid extraction means. This advantageously enables, for example, the cleaning of the exit surface in question and, additionally or alternatively, the cleaning of at least one bearing surface delimiting the respective exit surface.

In an advantageous embodiment, the cleaning device comprises at least two cleaning elements. By connecting the at least two cleaning elements of the cleaning device, it is advantageously possible to clean multiple print heads of a nozzle bar, for example to clean multiple print heads simultaneously in different rows of print heads of a nozzle bar.

The cleaning element advantageously comprises at least one first ramp and at least one second ramp. This facilitates the positioning of the cleaning element on a print head and/or the movement of the cleaning element along the nozzle bar, for example during a cleaning operation.

Advantageously, a feed device that is directed toward at least one positioning gap between at least two print heads arranged side by side impedes and/or prevents the penetration of printing fluid and/or dirt into the positioning gap, for example, and/or the deposition and/or settling of printing fluid and/or dirt in the positioning gap in question. In a cleaning operation, for example, this can support the cleaning of the relevant positioning gap by means of a cleaning device, for example, and/or during a printing operation it can impede a deposition and/or settling of printing fluid and/or dirt.

The feed device preferably comprises at least one outlet opening, which has a greater maximum diameter than the extension of a relevant exit surface of the relevant print head in the direction of a shortest boundary of the respective exit surface. Thus, the positioning gap is preferably hit, in the region of the exit surface and, additionally or alternatively, in the region of at least one bearing surface that borders the respective exit surface, with a fluid ejected by the feed device.

BRIEF DESCRIPTION OF THE DRAWINGS

Exemplary embodiments of the invention are illustrated in the set of drawings and will be described in greater detail in the following.

The drawings show.

DESCRIPTION OF PREFERRED EMBODIMENT

Figure 1:
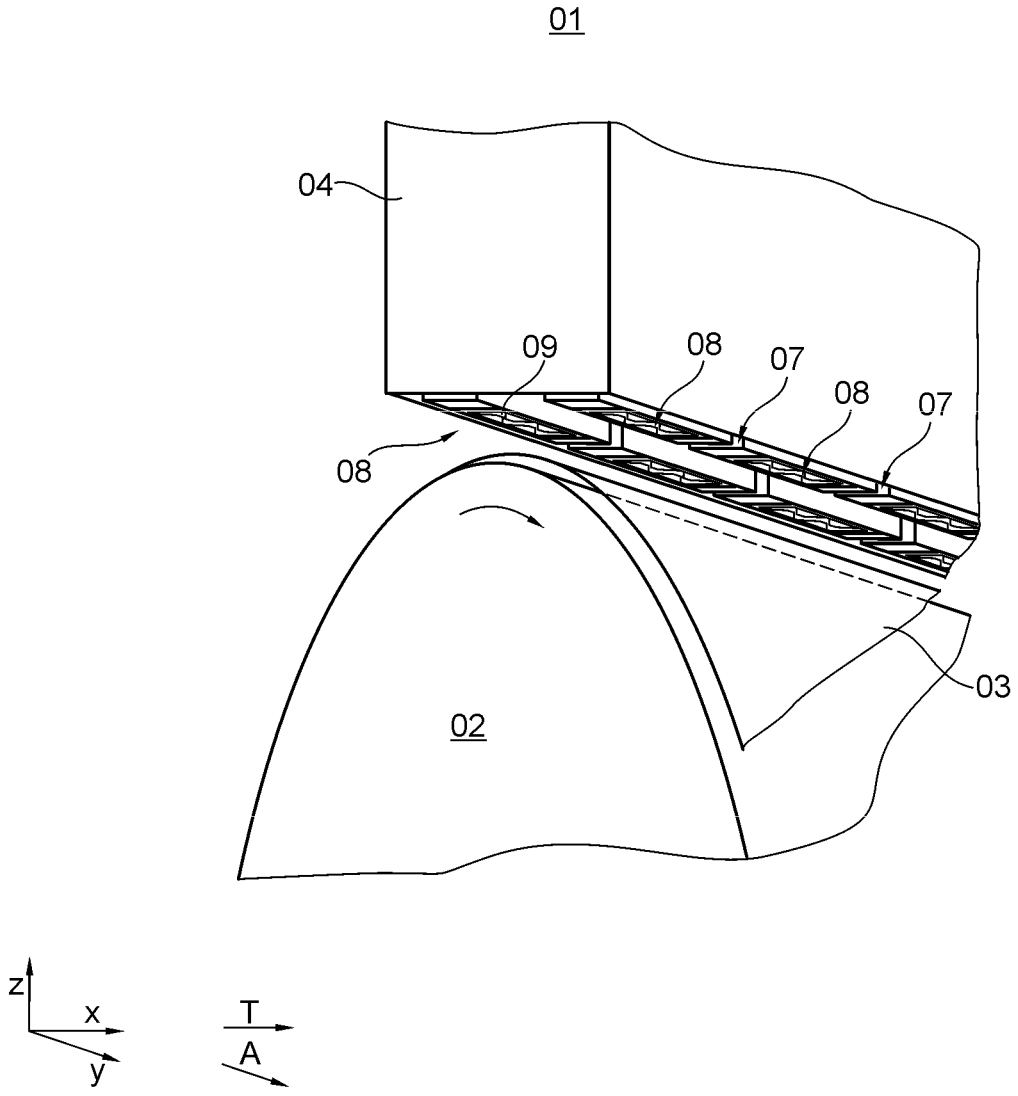
FIG. 1 a schematic, perspective illustration of at least one printing unit having at least one nozzle bar and at least one opposing printing substrate guide element, along with a printing substrate.
Figure 2A:
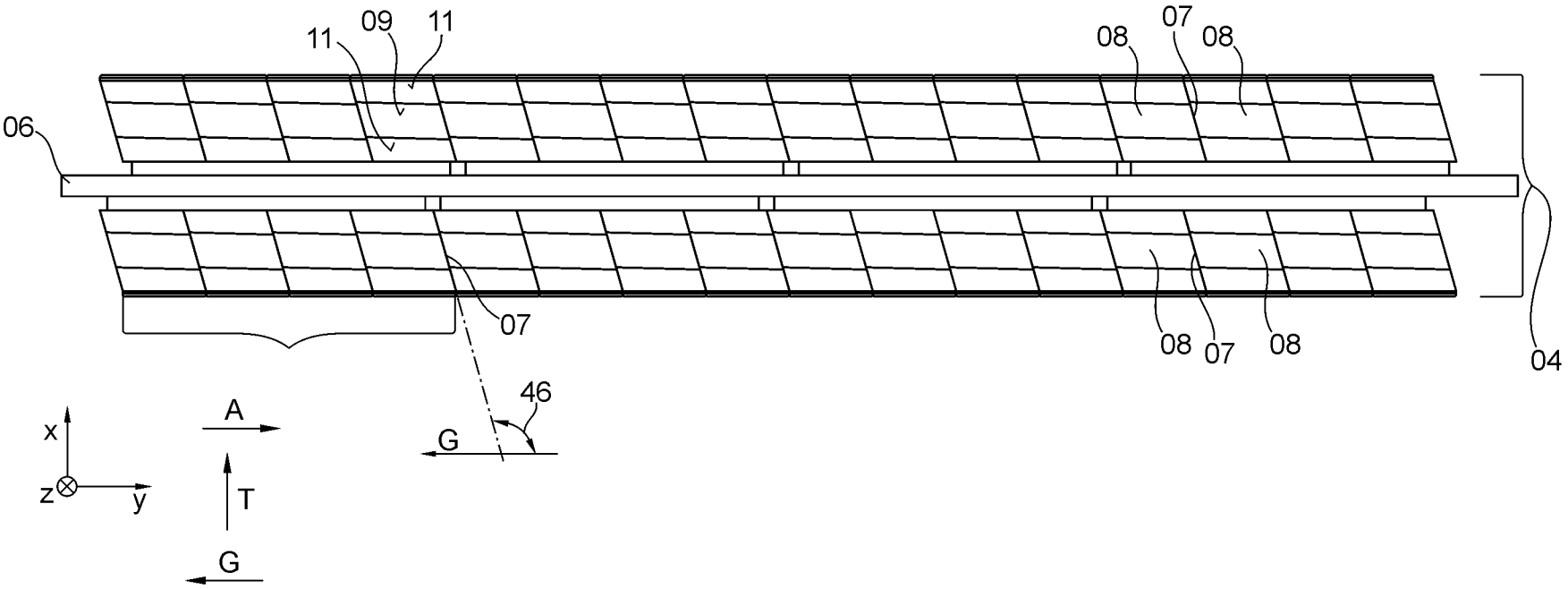
FIG. 2*a* a schematic illustration of at least one nozzle bar with two rows of diagonally overlapping print heads.
Figure 2B:
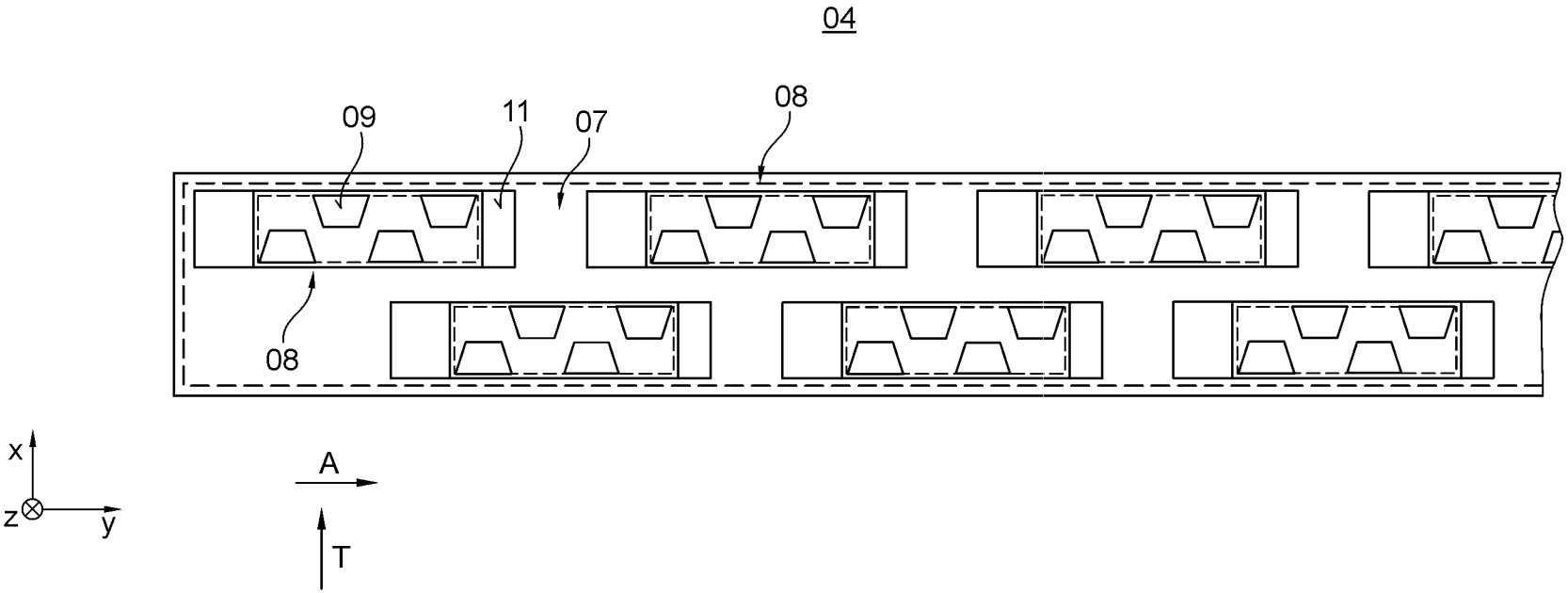
FIG. 2*b* a schematic illustration of an alternative embodiment of at least one nozzle bar having multiple print heads, which are arranged offset from one another in a double row.

A printing press comprises at least one printing unit 01 and at least one printing substrate guide element 02 for guiding at least one printing substrate 03. The at least one printing unit 01, which is embodied in particular as a non-impact printing unit 01, preferably as an inkjet printing unit 01, comprises at least one nozzle bar 04 having at least one print head 08, preferably at least one inkjet print head 08. At least one printing substrate guide element 02 is preferably associated with said nozzle bar 04. The at least one print head 08 has at least one exit surface 09.

For the purposes of this document, the printing press is a machine that applies and/or is capable of applying at least one printing fluid to at least one printing substrate 03.

Each at least one nozzle bar 04 preferably comprises at least two print heads 08, which are arranged side by side in a y direction, in particular adjoining one another, preferably adjacent to one another, and/or which extend in particular over an entire working width of the printing unit 01. The respective print heads 08 of each nozzle bar 04 are preferably arranged in at least one row in the y direction. The at least one nozzle bar 04 preferably extends over the entire working width of the printing unit 01. In particular, at least two print heads 08 of each nozzle bar 04 are arranged side by side in a y direction, for example, and/or are connected to one another in the y direction via a fixed axle, for example, to form a group of print heads 08.

The y direction and an x direction and a z direction form a Cartesian system of coordinates. The x direction corresponds to the direction along the shortest side of the respective nozzle bar 04. The y direction corresponds to a direction along the longest side of the respective nozzle bar 04. The z direction is preferably parallel to a normal vector of a plane that is spanned by the x direction and the y direction.

A transverse direction A is preferably a direction that runs parallel to the longest side of the at least one nozzle bar 04 in each case. The transverse direction A is preferably parallel to the y direction. The x direction is preferably orthogonal to the transverse direction A. The working width is, in particular, parallel to the transverse direction A. Furthermore, the transverse direction A is preferably orthogonal to a transport direction T.

In the above and in the following, the working width is the maximum width a printing substrate 03 may have in order to still be processed by the at least one printing unit 01 of the printing press; thus, this corresponds to the maximum width of the respective printing substrate 03 that can be processed by the at least one printing unit 01 of the printing press. The working width preferably corresponds to the dimension along the y direction of the at least one exit surface 09 of at least one print head 08, which is preferably used for printing the printing substrate 03.

In the above and in the following, the printing substrate 03 is a substrate that can be printed with a medium, in particular a printing fluid, by the at least one printing unit 01. The printing substrate 03 is preferably in the form of paper and/or cardboard and/or film, for example a plastic film, and/or textile and/or metal. The printing substrate 03 is particularly in the form of a web or sheet.

The spatial area provided for the transport of a printing substrate 03, which the printing substrate 03 occupies at least temporarily when it is present, is the transport path. The transport path is defined by at least one transport means, in particular by the at least one printing substrate guide element 02. Each at least one printing substrate guide element 02 is preferably configured as at least one roller and/or at least one cylinder and/or at least one support and/or at least one other device for guiding the printing substrate 03 in a printing operating mode of the printing press.

The transport direction T is a direction, provided for a printing operating mode of at least one printing unit 01 of the printing press, in which the printing substrate 03, when present, is transported at any point along the transport path. The transport direction T is preferably a direction that runs parallel to the shortest side of the at least one nozzle bar 04 in each case. The transverse direction A is the axial direction orthogonal to the transport direction T. For example, the transport direction T is preferably parallel to the x direction and/or, for example, the transverse direction A is parallel to the y direction of the Cartesian system of coordinates at the location where the distance between a relevant print head 08 and the transport path is the shortest.

In the above and in the following, a printing fluid refers to inks, printing inks, and/or varnishes, along with other materials that are and/or can be transferred to a printing substrate 03 by a printing press or by at least one printing unit 01 of the printing press. A printing fluid, particularly in the form of droplets, located in a volume of the print head 08 can preferably leave the volume of said print head 08 through an opening in the exit surface 09.

In the above and in the following, a cleaning agent and/or cleaning fluid refers in particular to a liquid that is used for cleaning individual components of a printing press, in particular for cleaning at least one exit surface 09 of at least one print head 08. The cleaning agent is preferably used to remove residues of the at least one printing fluid on components of the printing press, in particular on the exit surface 09 of at least one print head 08 and/or in a positioning gap 07 between two side-by-side print heads 08. The cleaning agent contains water and/or at least one surfactant and/or at least one solvent, for example.

A printing unit 01 comprises at least one nozzle bar 04. For example, a printing unit 01 comprises at least two nozzle bars 04, preferably at least four nozzle bars 04, for example precisely four nozzle bars 04. The at least one nozzle bar 04 is arranged in at least one printing position, for example, shown by way of example in FIG. 1. The printing position describes the specific position of the nozzle bar 04 in which the nozzle bar 04 is disposed in a printing operating mode of the printing press. A respective print head 08 disposed in its printing position is preferably characterized in that the respective exit surface 09 is separated from the provided transport path for at least one printing substrate 03 and/or from the at least one printing substrate 03 and/or from the printing substrate guide element 02 associated with the respective nozzle bar 04 by a distance of no more than 5 mm (millimeters), preferably no more than 1.5 mm and/or by a distance of at least 0.5 mm, preferably at least 1.0 mm.

When the printing press is in a printing operating mode, at least one printing substrate 03 is guided along the transport direction T by means of the at least one printing substrate guide element 02, for example, through a spatial area between the respective printing substrate guide element 02 and the nozzle bar 04 in question. Each at least one print head 08, which has at least one exit surface 09, is positioned in the relevant nozzle bar 04 facing the printing material guide element 02.

The at least one nozzle bar 04 comprises at least two print heads 08. The at least two print heads 08 are arranged side by side, in particular adjacent to one another. Preferably, the at least two print heads 08 are arranged side by side along the y direction, in particular adjoining one another, preferably adjacent to one another, and/or preferably overlapping one another partially in the x direction. The individual print heads 08 of the nozzle bar 04 in question are preferably arranged in at least one row of print heads 08 along the y direction, preferably in at least two, in particular parallel rows of print heads. The respective exit surfaces 09 of at least two print heads 08 arranged side by side, preferably adjacent to one another, in particular in a row, are preferably each positioned spaced apart from one another, in particular in the y direction, by the at least one positioning gap 07. The at least two print heads 08 arranged side by side in the y direction are preferably arranged spaced apart from one another by the at least one positioning gap 07. The at least two print heads 08 arranged side by side in the y direction, in particular adjacent to one another, in particular the respective exit surfaces 09 of the print heads 08 arranged side by side in the y direction, further preferably delimit the corresponding positioning gap 07 in the y direction. This facilitates the positioning of the respective print heads 08, for example.

In one exemplary embodiment of a nozzle bar 04, the print heads 08 of the nozzle bar 04, which are preferably arranged in a row in the y direction, are preferably arranged at least partially overlapping one another diagonally in the x direction, for example, preferably in the transport direction T, and/or the respective exit surfaces 09 of the corresponding print heads 08 are preferably arranged spaced apart from one another in the y direction in each case by the one positioning gap 07.

In an alternative embodiment of a nozzle bar 04, the nozzle bar 04 comprises, for example, at least two preferably parallel rows of print heads 08, with one row comprising at least two print heads 08, preferably a plurality of print heads 08, in the y direction. In that case, the print heads 08 of the rows each arranged in the y direction are preferably each offset from one another in the x direction, as a result of which the respective exit surfaces 09 of the print heads 08, which are offset from one another in each case, overlap one another at least partially.

A print head 08 comprises the at least one exit surface 09 and at least one, in particular at least two bearing surfaces 11. The at least one bearing surface 11 is preferably configured as a spacer surface 11. The bearing surface 11 is preferably configured such that the exit surface 09 is positioned to avoid any unwanted contact with components or other bodies, for example during cleaning of the exit surface 09. The spacer surface 11 preferably extends over the entire extension of the respective print head 08. However, dimensions over only part of the extension of the respective print head 08 are also possible.

The exit surface 09 of a print head 08 is a surface of the respective print head 08 that faces the transport path and, in particular, lies in a plane the normal vector of which is arranged parallel to the z direction. The exit surface 09 is formed as a parallelogram, for example, preferably as a non-rectangular parallelogram. In another exemplary embodiment the exit surface 09 is a trapezoid, in particular an isosceles trapezoid. The exit surface 09 preferably comprises at least one opening, in particular a multiplicity of openings, through which the printing fluid can exit at least one volume, in particular a multiplicity of volumes of the print head 08 in question, preferably in the form of droplets.

An exit direction of the at least one exit surface 09 is the direction in which the printing fluid, in particular in the form of droplets, exits and/or can exit the respective print head 08 through at least one opening in the corresponding exit surface 09. The exit direction of the exit surface 09 is parallel, preferably at least in one component and more preferably completely, to a surface normal of the exit surface 09 of the respective print head 08.

The respective exit surfaces 09 of the relevant print heads 08 of a nozzle bar 04, which are arranged side by side in the y direction, are preferably arranged at least partially adjacent to one another, more preferably at least partially overlapping, in the x direction. The sum of all exit surfaces 09 preferably extends within at least one row, arranged in the y direction, of print heads 08 of a nozzle bar 04, for example also within at least two rows, over the entire working width of the respective nozzle bar 04. Thus, every position on the transport path along a straight line in the y direction is assigned an opening within an exit surface 09 of the relevant nozzle bar 04, through which the printing fluid can exit a volume of a corresponding print head 08 of the nozzle bar 04.

Within each nozzle bar 04, at least two print heads 08 are preferably arranged side by side, in particular adjacent to one another, in the y direction. In particular, within each row of print heads 08, two print heads 08 are arranged adjacent to one another in the y direction. To enable the positioning the relevant at least two adjacent print heads 08 of the corresponding nozzle bar 04, for example, the respective exit surfaces 09 of the at least two print heads 08 are preferably arranged spaced apart from one another in each case by the one positioning gap 07. The at least one positioning gap 07 preferably extends no more than 0.5 mm (millimeters), in particular no more than 0.2 mm, in the y direction. In particular, the at least one positioning gap 07 extends at least 0.05 mm, preferably at least 0.1 mm, in the y direction.

A cleaning direction G and/or the y direction forms a preferably plane angle, in particular a positioning angle 46, of at least 50°, preferably at least 60°, and of no more than 130°, preferably no more than 120°, in a positive mathematical direction of rotation, meaning rotated counterclockwise, with a longitudinal direction of the positioning gap 07. From this it is particularly clear, for example, that the longitudinal direction of the positioning gap 07, preferably the positioning angle 46 of the longitudinal direction of the positioning gap 07, is located in the plane that is spanned by the x direction and the y direction. The longitudinal direction of the positioning gap 07 is preferably the direction of greatest extension of the positioning gap 07. The longitudinal direction of the positioning gap 07 is preferably oriented with at least one component orthogonally to the cleaning direction G within the plane spanned by the x direction and the y direction. The positioning angle 46 thus corresponds, for example, to the at least partial diagonal overlap in the x direction of at least two print heads 08 arranged side by side, in particular adjacent to one another.

At least one feed device 13 for ejecting a fluid is preferably assigned to each respective positioning gap 07. The at least one feed device 13 is preferably configured as a nozzle 13, in particular as a cleaning nozzle 13. The feed device 13 is further preferably configured as a nozzle 13 for ejecting fluid, preferably a gaseous fluid and/or pressurized gas. The feed device 13 is preferably arranged such that a fluid, for example a compressed gas and/or a gas mixture, in particular air, and/or a liquid, can flow through the respective feed device 13, so that the fluid can exit the feed device 13 in an outlet direction L, in particular through an outlet opening 17. At least one component of the outlet direction L is preferably directed toward the respective positioning gap 07, preferably in the z direction. At least one feed device 13 for ejecting a fluid and having an outlet direction L is preferably assigned to the respective positioning gap 07, with at least one component of the outlet direction L being directed toward the respective positioning gap 07. The outlet opening 17 of the feed device 13 is preferably directed, for example, from above and/or from above the printing substrate guide element 02 in the direction of the printing substrate guide element 02 onto the positioning gap 07.

The feed device 13 preferably comprises at least one infeed element 14 and/or at least one outlet element 16; 43, each at least one outlet element 16; 43 preferably being configured as at least one restricting element 16 and/or as at least one opening element 43, and/or the at least one outlet opening 17. The feed device 13 preferably has at least one cavity, which is preferably connected to the at least one outlet opening 17. Each at least one outlet element 16; 43 is configured as at least one metal plate or as a tube, for example. The restricting element 16 is preferably configured as flat, for example as a flat metal plate. The at least one opening element 43 preferably comprises at least one recess 17, which is further preferably configured as the at least one outlet opening 17.

In a preferred embodiment, each at least one feed device 13 is preferably connected to at least one print head 08 of the relevant print heads 08, which delimit the respective positioning gap 07. Additionally or alternatively, the at least one nozzle bar 04 preferably comprises the at least one feed device 13, with the feed device 13 preferably being positioned in the z direction on the side of the exit surface 09 that faces away from the at least one opening of the respective exit surface 09. Additionally or alternatively, the at least one nozzle bar 04 preferably comprises the at least one feed device 13, with the feed device 13 preferably being arranged in the z direction on the side of at least one exit surface 09 of at least one print head 08 of the corresponding nozzle bar 04, which side faces away from the transport path, and/or with the respective outlet direction L of each at least one feed device 13 being directed toward at least one positioning gap 07 between two print heads 08, which are preferably adjacent to one another in the y direction.

Preferably, the at least one feed device 13 is arranged in the z direction on the side of the respective exit surface 09 that faces away from the transport path. Further preferably, the at least one feed device 13 is positioned on the side of the print head 08, in particular on the side of the exit surface 09, on which the print head 08 is attached to the corresponding nozzle bar 04. Further preferably, the at least one feed device 13 is positioned such that the outlet direction L is directed from one side of the print head 08, in particular one side of the exit surface 09, onto the at least one positioning gap 07, at which the print head 08 is attached to the corresponding nozzle bar 04.

The feed device 13 is preferably arranged spaced apart from the positioning gap 07 in the z direction. More preferably, the feed device 13 is arranged adjacent to the positioning gap 07 in the z direction. The outlet opening 17 is preferably arranged at a distance from the positioning gap 07 in the z direction. More preferably, the outlet opening 17 is arranged adjacent to the positioning gap 07 in the z direction. This means that the feed device 13, in particular the respective outlet opening 17, is preferably located at a distance in the z direction from the respective exit surfaces 09 of two print heads 08, which are arranged side by side in the y direction and the exit surfaces 09 of which border the corresponding positioning gap 07.

The outlet direction L is preferably a direction in which a fluid, for example a gas and/or a gas mixture, in particular air, and/or a liquid can exit the relevant feed device 13, preferably through the at least one outlet element 16; 43, in particular the at least one outlet opening 17. The outlet direction L is preferably parallel in at least one component to and/or points in an identical direction to the exit direction of the at least one exit surface 09 of a print head 08 of the nozzle bar 04. More preferably, at least one component of the outlet direction L is parallel to and/or points in an identical direction to the surface normal of the exit surface 09 of the respective print head 08 and/or to a direction in which the printing fluid can exit the respective exit surface 09.

The outlet direction L is preferably parallel to a main direction, which is preferably defined by at least one side wall of the feed device 13, which is further preferably defined by the at least one restricting element 16. The outlet direction L preferably has at least one component in the z direction, said component in the z direction preferably facing the transport path. For example, the outlet direction L comprises at least one component in the z direction and at least one component in the x direction, the component in the z direction being greater than the component in the x direction.

The outlet direction L is preferably a direction within a plane that extends, at the position of the positioning gap 07, for example, along the y direction displaced through the z direction and through at least one direction of a shortest boundary, which extends in a plane in the x direction and the y direction, of the respective exit surface 09 of the relevant print head 08, which exit surface preferably borders the positioning gap 07.

In a preferred embodiment, the dimension of the at least one feed device 13 in the y direction is identical to the dimension of the respective positioning gap 07 in the y direction. Further preferably, the at least one feed device 13 has a maximum dimension in the y direction of 0.5 mm (millimeters), in particular a maximum of 0.2 mm. Further preferably, the at least one feed device 13 has a dimension in the y direction of at least 0.05 mm, preferably of at least 0.1 mm.

In the plane that is spanned by the z direction and at least one direction of the shortest boundary, which spans a plane in the x direction and y direction, of the respective exit surface 09 of the relevant print head 08, wherein the respective exit surface 09 borders the positioning gap 07, the outlet opening 17 is preferably configured such that the outlet opening 17 in question has a smaller dimension in the z direction remote from the respective exit surface 09, in particular remote from the transport path, than in the z direction near the exit surface 09, in particular near the transport path. In the plane that, at the position of the positioning gap 07, extends, for example, along the y direction displaced through the z direction and through at least one direction of the shortest boundary, which extends in a plane in the x direction and y direction, of the respective exit surface 09 of the relevant print head 08, which exit surface borders the positioning gap 07, the outlet opening 17 preferably has the shape of a two-dimensional longitudinal section of a cone, for example. Additionally or alternatively, the diameter of the outlet opening 17, measured in the direction of the shortest boundary, which extends in a plane in the x direction and y direction, of the exit surface 09, which borders the positioning gap 07, preferably increases along the z direction in the direction of the transport path. The at least one outlet opening 17 preferably has its maximum diameter at the point of the feed device 13 that has the shortest distance from the respective positioning gap 07. Further preferably, the maximum diameter of the corresponding outlet opening 17 is greater than the dimension of the at least one exit surface 09 of the relevant print head 08, which is located at the corresponding positioning gap 07, in the direction of the shortest boundary of the respective exit surface 09.

The restricting element 16 preferably delimits the respective outlet opening 17 on one side in the y direction. The respective restricting element 16 is preferably in direct contact with the respective opening element 43. The infeed element 14 is further preferably in direct contact with the respective opening element 43, and therefore, a connection preferably exists between at least one cavity of the infeed element 14 and the respective outlet opening 17. The opening element 43 and in particular the respective outlet opening 17 of the corresponding feed device 13 is further preferably arranged between the respective restricting element 16 and the respective infeed element 14.

The infeed element 14 preferably comprises the at least one cavity, the cavity being connected to at least one source for supplying the at least one fluid, for example a gas and/or a gas mixture, in particular air, and/or a liquid, and to the outlet opening 17.

Figure 3A:
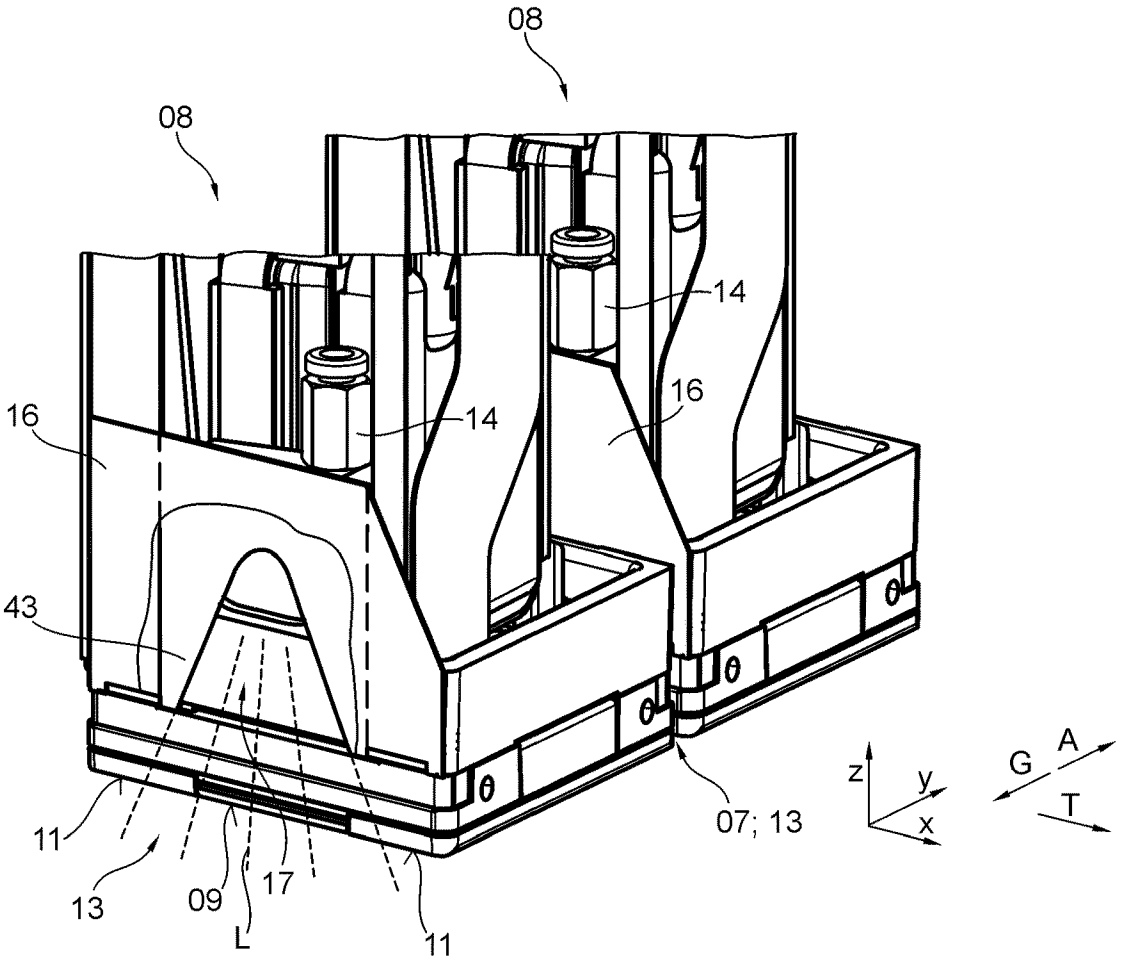
FIG. 3*a* a schematic, perspective illustration of at least two print heads, arranged spaced apart from one another by a positioning gap, with at least a first feed device associated with the positioning gap, and a second feed device, the second feed device being shown in cross section.
Figure 3B:
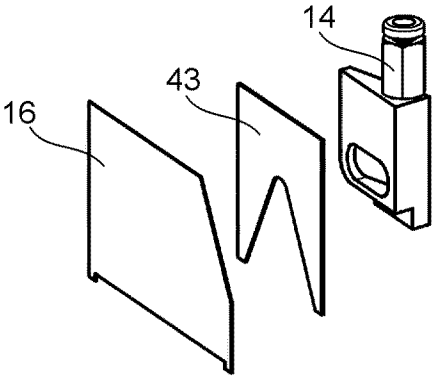
FIG. 3*b* a schematic exploded view of an exemplary feed device.

A fluid, for example a gas and/or gas mixture and/or a liquid, for example, can be supplied by the at least one source. The at least one fluid, in particular compressed gas, flows through the cavity of the infeed element 14, for example, arriving at the restricting element 16, preferably via the recess 17 of the opening element 43. At the restricting element 16, the fluid, for example the gas and/or the gas mixture and/or the liquid, is deflected in such a way, for example, that the fluid preferably exits the respective feed device 13 in the outlet direction L through the at least one outlet opening 17. The fluid, for example the gas and/or the gas mixture and/or the liquid, preferably has a pressure of at least 0.1 bar, in particular at least 0.2 bar, and of no more than 0.7 bar, in particular no more than 0.5 bar, when it exits the feed device 13. In FIG. 3, the exiting of the fluid in the exit direction L is indicated by dashed lines, by way of example.

The nozzle bar 04 comprises at least one positioning guide 06, which is preferably arranged to be movable, in particular linearly movable. The respective nozzle bar 04, in particular the respective print heads 08 of the nozzle bar 04, preferably is/are and/or can be positioned as desired in the at least one printing position and/or at least one idle position and/or at least one maintenance position by means of the respective positioning guide 06.

The at least one maintenance position is preferably a position in which the at least one print head 08 of the relevant nozzle bar 04 can be serviced, for example cleaned and/or aligned, preferably without removing the corresponding print head 08 from the nozzle bar 04 and/or the printing unit 01 and/or the printing press. The respective maintenance position of a nozzle bar 04, in particular of the relevant print heads 08, is preferably characterized in that the distances between different nozzle bars 04 arranged in their respective maintenance positions are different from the distances between said nozzle bars in their respective printing positions and/or in their respective idle positions. The distance of the respective exit surface 09 of a print head 08 arranged in a maintenance position from the intended transport path for at least one printing substrate 03 and/or from the at least one printing substrate 03 and/or from the printing substrate guide element 02 associated with the respective nozzle bar 04 is preferably greater than the distance in the corresponding printing position.

The idle position is preferably a position in which the at least one print head 08 can be removed from the printing press and/or the at least one printing unit 01 and/or the at least one nozzle bar 04, and/or can be inserted into the printing press and/or the at least one printing unit 01 and/or the at least one nozzle bar 04. In the idle position, in particular, more space is preferably available for a press operator to access the at least one print head 08, whereas in the maintenance position, preferably only sufficient space is available to allow internal, in particular automatically running processes to be carried out within the printing press, for example a cleaning of at least one exit surface 09 of at least one print head 08.

Figure 4A:
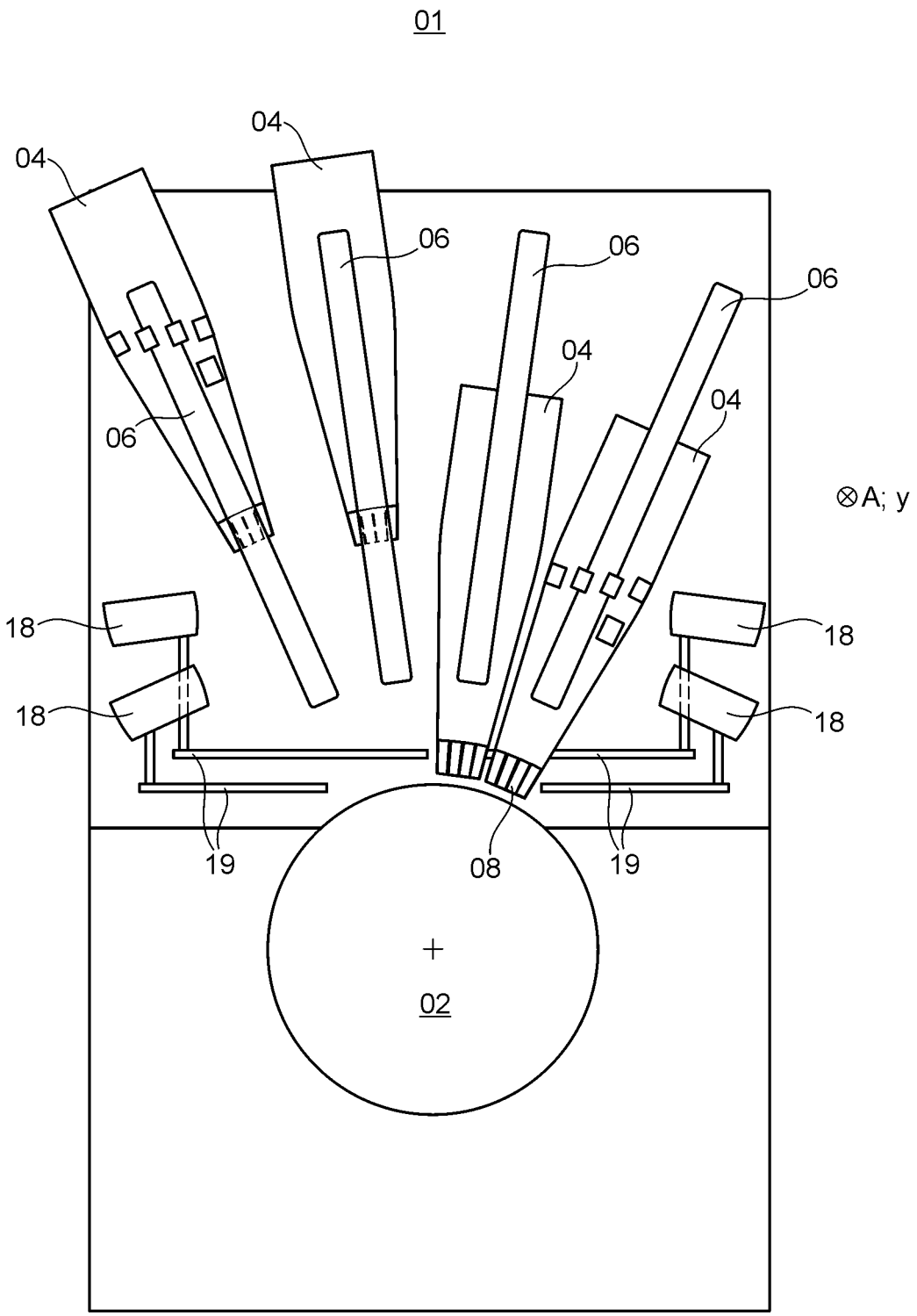
FIG. 4*a* a schematic illustration of a printing unit having multiple nozzle bars, at least one nozzle bar being arranged in the printing position and at least one nozzle bar being arranged in the idle position.
Figure 4B:
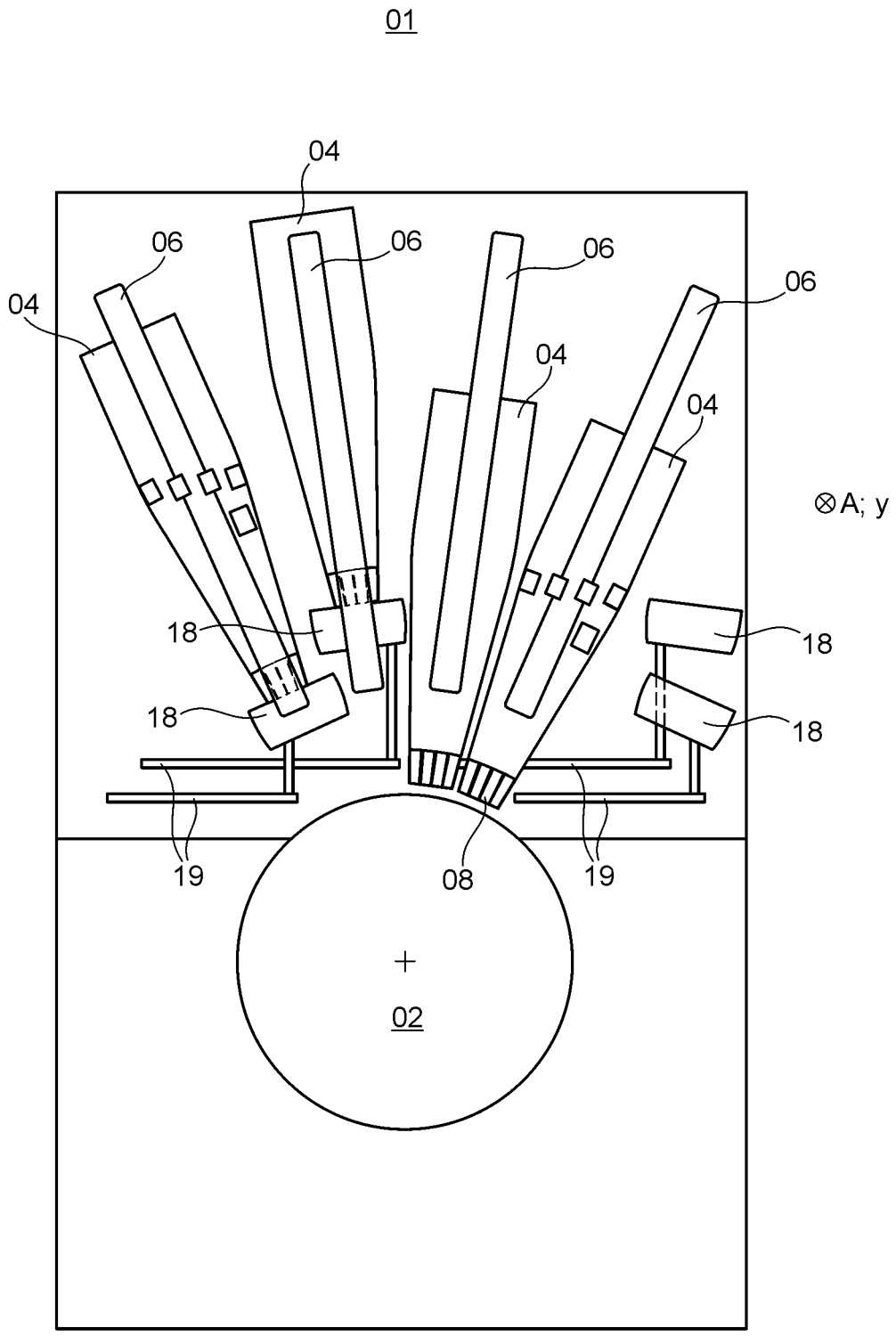
FIG. 4*b* a schematic illustration of a printing unit having multiple nozzle bars according to FIG. 4*a*, with at least one nozzle bar being arranged in the maintenance position.

FIG. 4*a* shows, by way of example, a schematic illustration of at least one printing unit 01 having multiple nozzle bars 04, with at least one nozzle bar 04 being disposed in the printing position and at least one nozzle bar 04 being disposed in the idle position. FIG. 4*b* shows, by way of example, a schematic illustration of a printing unit 01 having multiple nozzle bars 04 according to FIG. 4*a*, with at least one nozzle bar 04 being disposed in a maintenance position.

The at least one printing unit 01 comprises at least one cleaning device 18. Each nozzle bar 04 of each printing unit 01 is assigned at least one cleaning device 18. For example, the at least one print head 08 of a nozzle bar 04 disposed in the maintenance position is assigned a cleaning device 18, which is positioned in a cleaning position via a guidance system 19. The at least one cleaning device 18 is provided for cleaning the at least one exit surface 09 and/or the at least one bearing surface 11 of the at least one print head 08 of a corresponding nozzle bar 04. Additionally or alternatively, the at least one cleaning device 18 preferably cleans the at least one positioning gap 07.

Figure 5A:
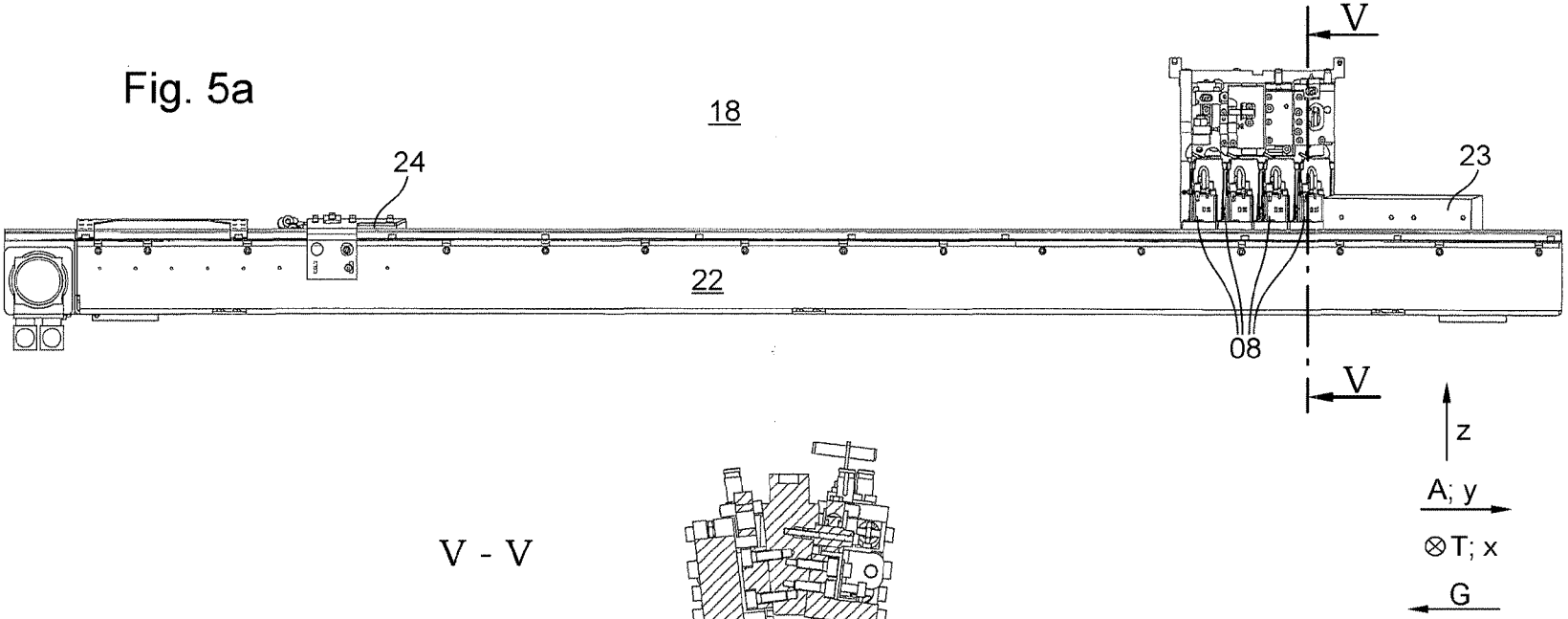
FIG. 5*a* a view of at least four print heads within one row of a nozzle bar and a cleaning device, with at least one cleaning element being arranged opposite and in direct or indirect contact with at least one print head, and with only four print heads being shown in the interest of clarity.
Figure 5B:
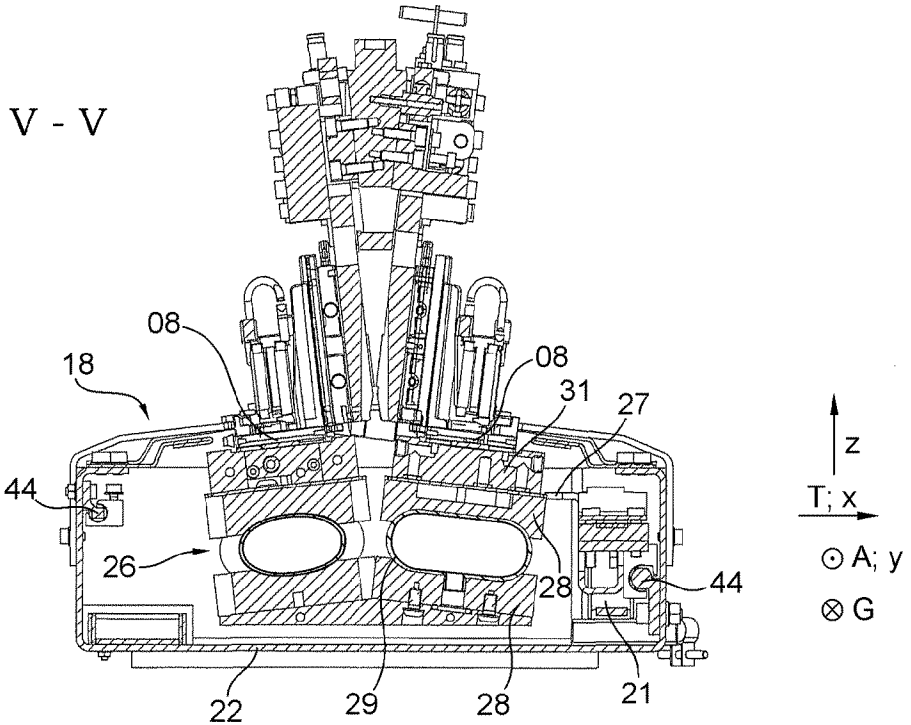
FIG. 5*b* a cross-sectional illustration of the print heads of the nozzle bar and of the cleaning device in a cross section along the line V-V in FIG. 5*a;*
Figure 6A:
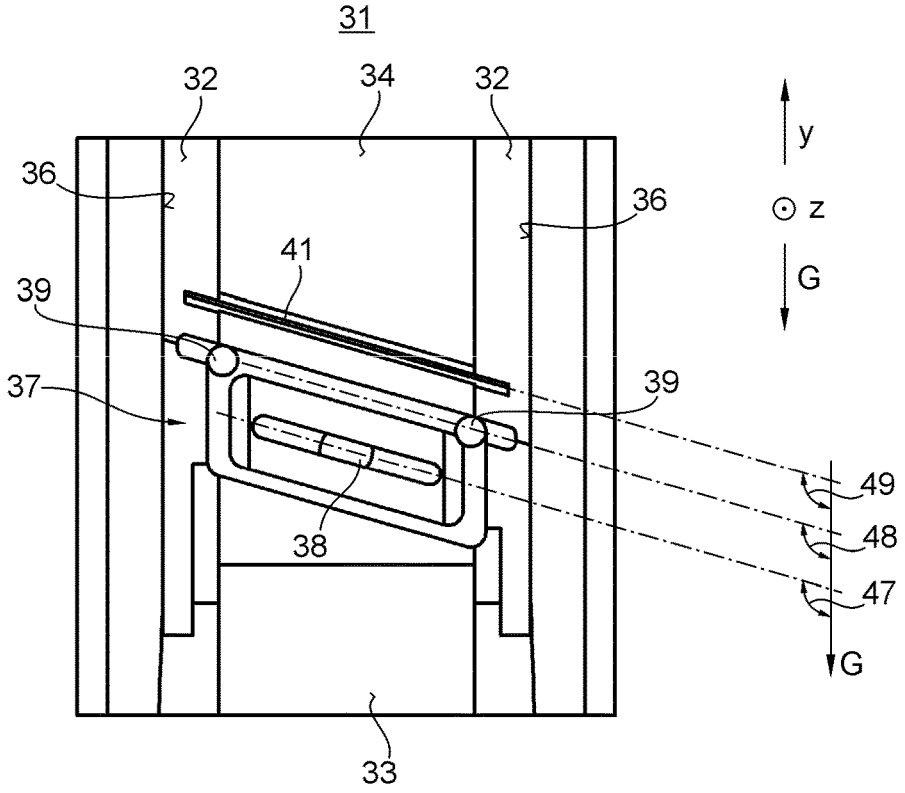
FIG. 6*a* a diagram of a cleaning element.
Figure 6B:
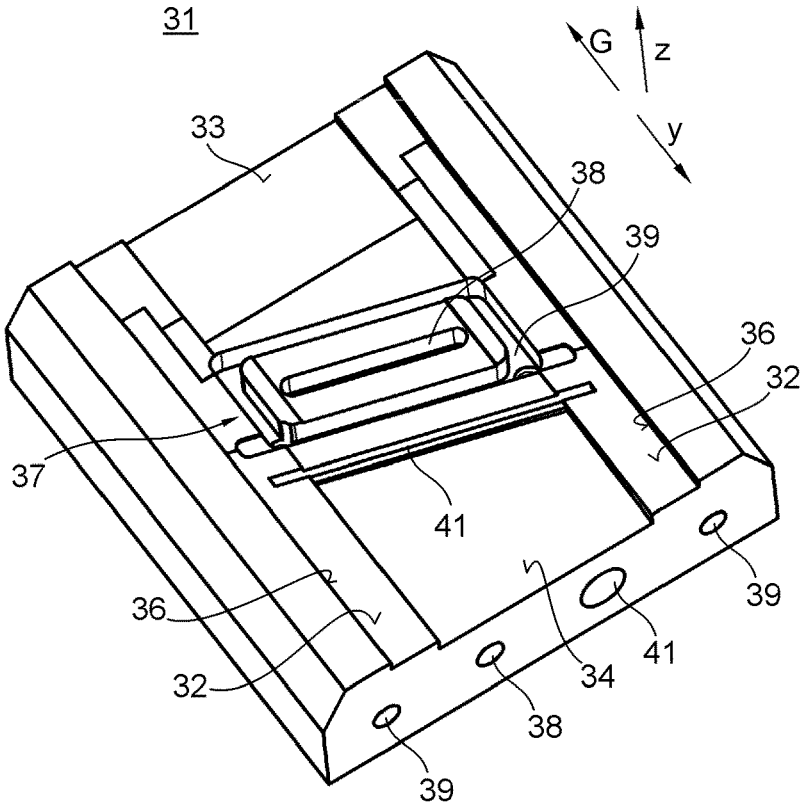
FIG. 6*b* a diagram of the cleaning element according to FIG. 6*a* in a perspective view.
Figure 6C:
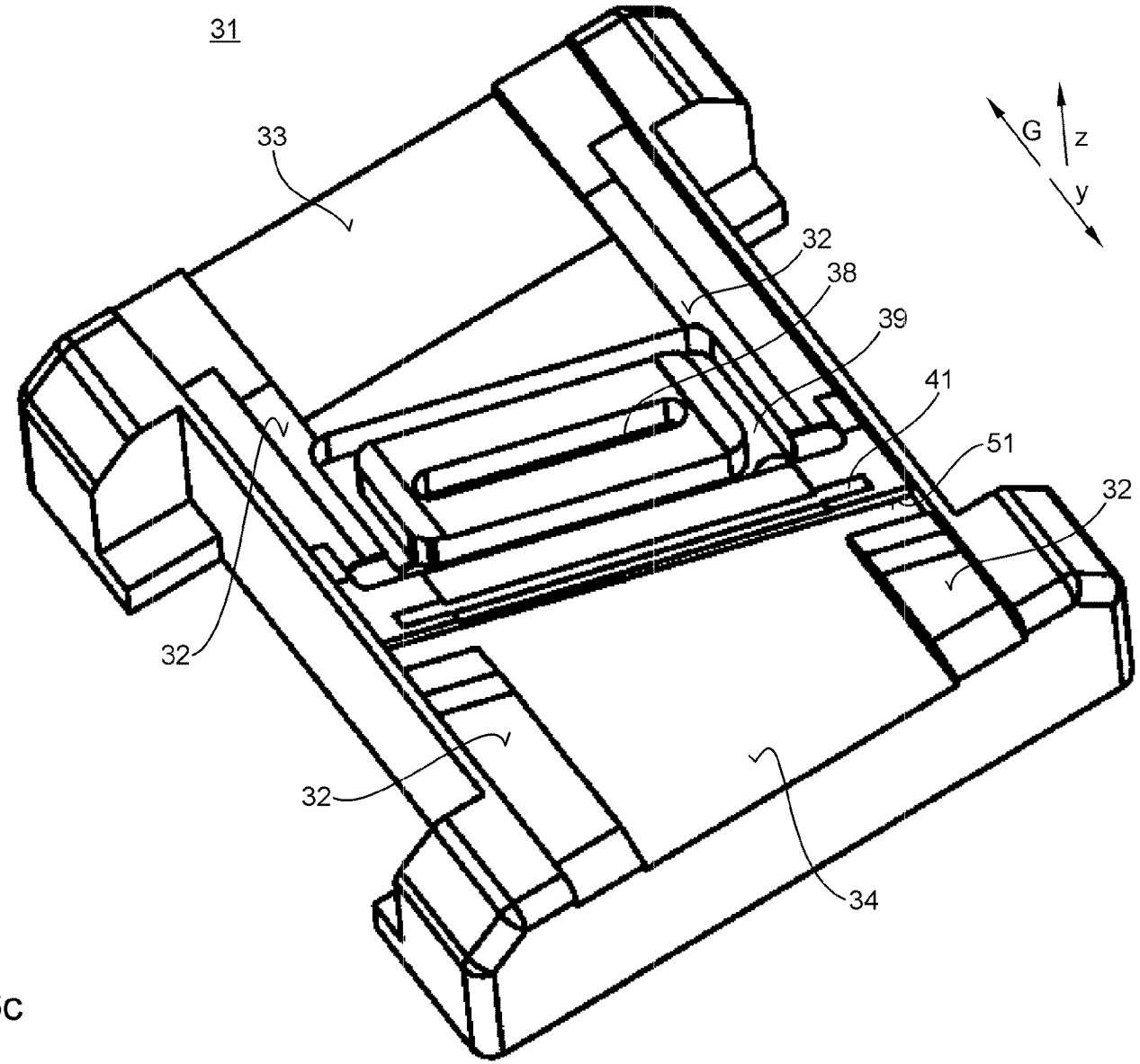
FIG. 6*c* a diagram of an alternative cleaning element in a perspective view.
Figure 7A:
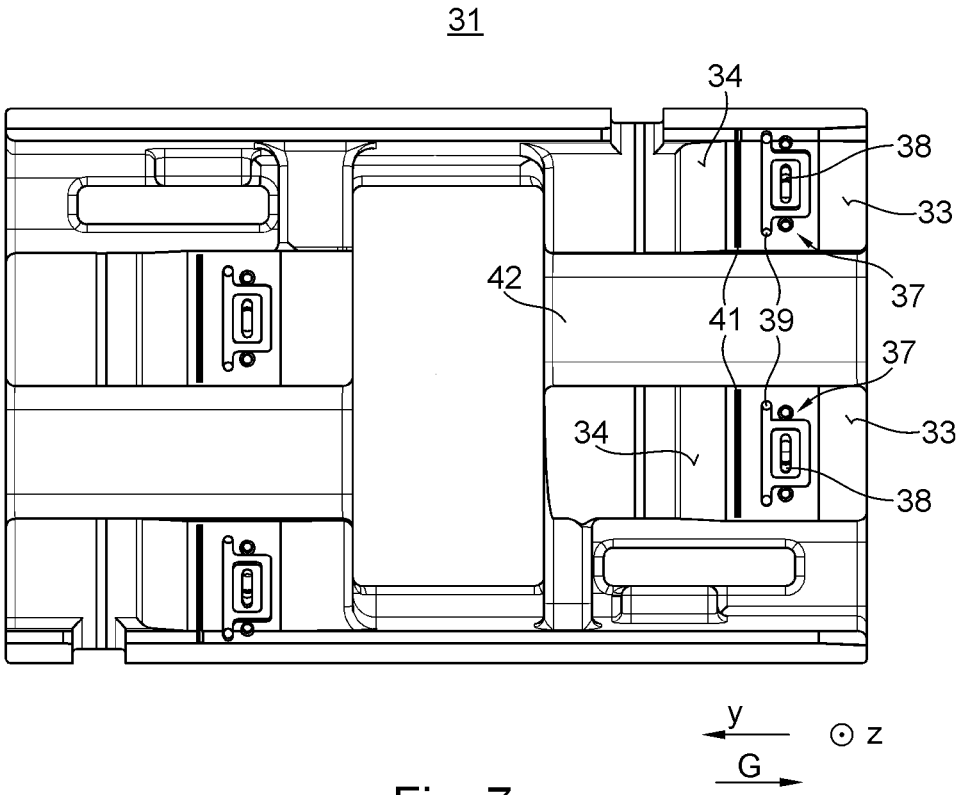
FIG. 7*a* a diagram of a further alternative embodiment of a cleaning element.
Figure 7B:
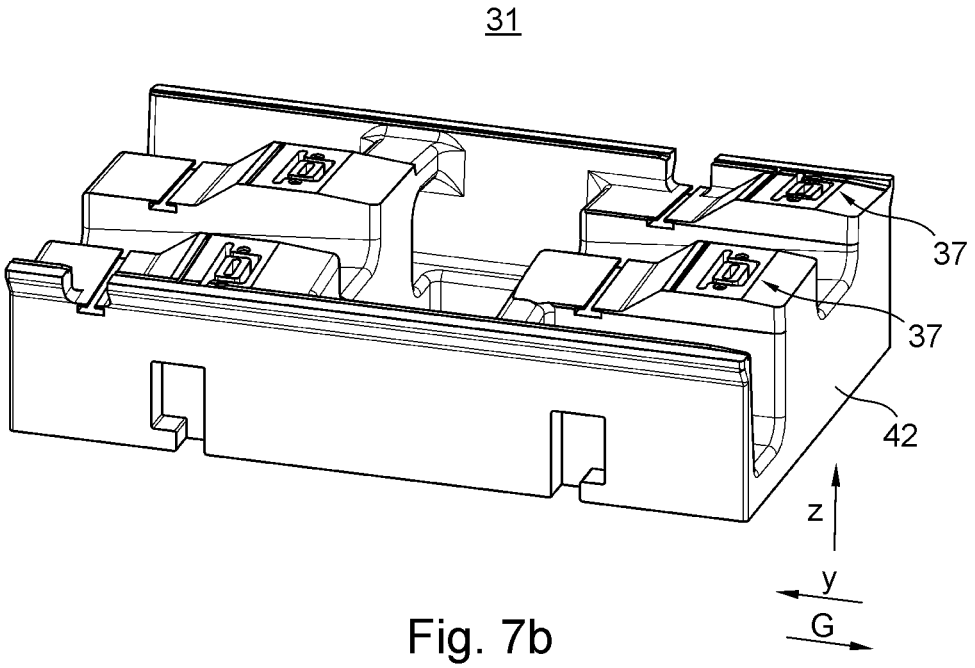
FIG. 7*b* a diagram of the further alternative embodiment of a cleaning element according to FIG. 7*a* in a perspective view.
Figure 7C:
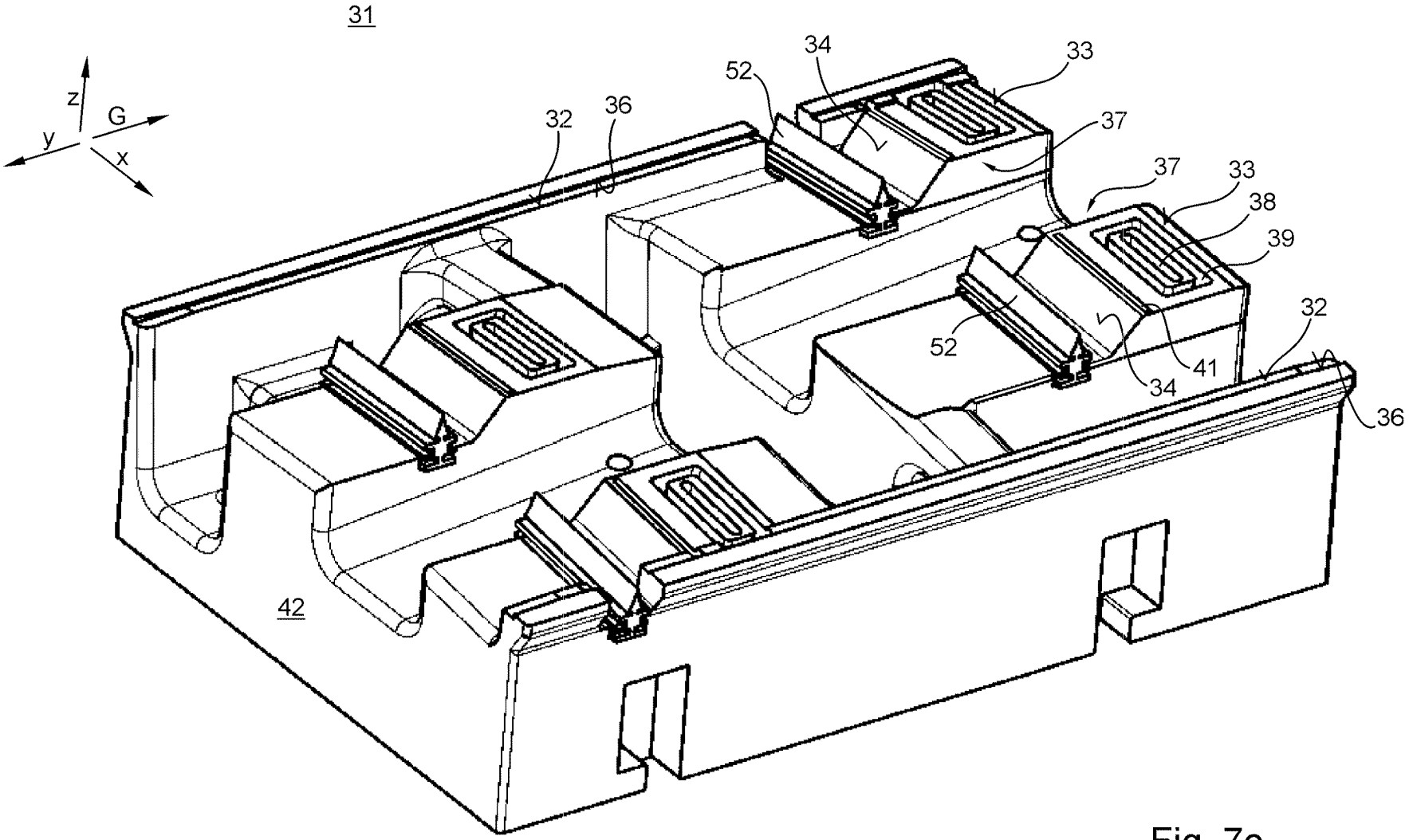
FIG. 7*c* a diagram of the further alternative embodiment of a cleaning element according to FIG. 7*a* and/or FIG. 7*b* with at least one additional wiper.
Figure 7D:
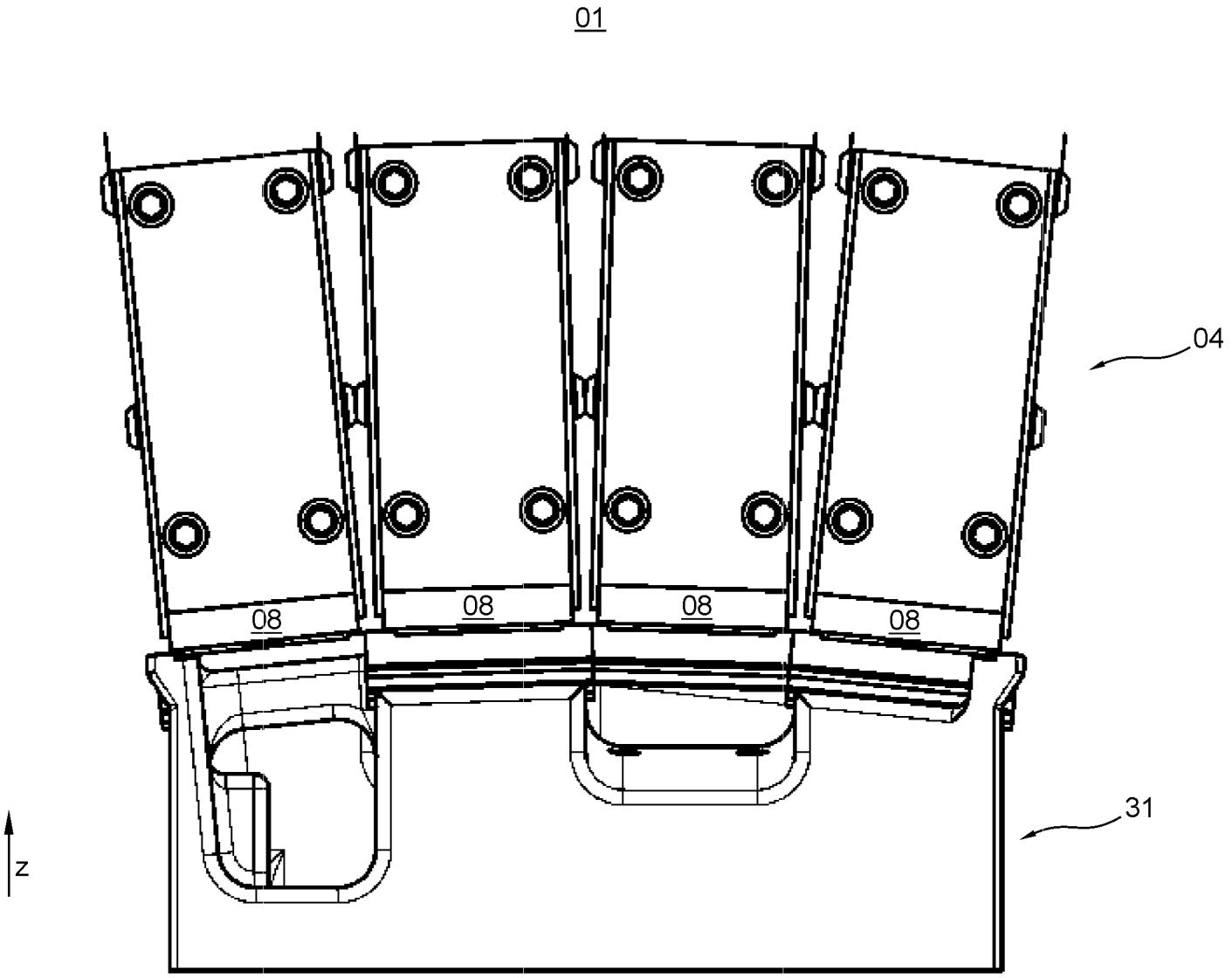
FIG. 7*d* an arrangement of a cleaning element with four cleaning regions on a nozzle bar having four rows of print heads.

FIG. 5*a* shows, by way of example, a corresponding cleaning device 18 in the cleaning position, which is preferably assigned to a nozzle bar 04 in the maintenance position. In the interest of clarity, only four print heads 08 of the nozzle bar 04 in question are shown.

The cleaning position of the at least one cleaning device 18 preferably corresponds to a position in which the cleaning device 18 is in direct or indirect contact with at least one print head 08 of the nozzle bar 04 in question, in particular one such print head to be cleaned, and/or preferably to a position in which the cleaning device 18 is positioned for carrying out the cleaning of the at least one print head 08 of the nozzle bar 04 in question.

The at least one cleaning device 18 is preferably movable, in particular in its entirety, at least orthogonally to the transverse direction A, preferably via at least one guidance system 19. In the at least one maintenance position of each at least one nozzle bar 04, at least one cleaning device 18 is and/or can be assigned to at least one exit surface 09 of at least one print head 08 in each case, in particular one exit surface 09 of at least two, preferably at least three, and more preferably of at least four print heads 08 in each case. A printing unit 01 preferably comprises at least one cleaning device 18 per nozzle bar 04. In a preferred embodiment, at least two cleaning devices 18 are connected to a preferably common guidance system 19 and/or are configured as movable and/or moving by means of the one preferably common guidance system 19.

In the maintenance position of the at least one nozzle bar 04, the cleaning device 18 assigned to the corresponding nozzle bar 04 is preferably configured as at least one locking element, for example in the form of at least one maintenance stop. In its maintenance position, the nozzle bar 04 that comprises the corresponding print head 08 is preferably pulled and/or pressed against the cleaning device 18, preferably by the application of a force and/or, for example, by the force of gravity. The maintenance position of the at least one nozzle bar 04 is thereby preferably clearly defined.

The at least one cleaning device 18 preferably comprises at least one cleaning guide 44 and/or at least one cleaning drive 21 and/or at least one collecting pan 22 and/or at least one support means 23; 24 and/or at least one cleaning unit 26, preferably at least one cleaning unit 26 per row of print heads 08 in the y direction of the nozzle bar 04 in question. Preferably, the at least one cleaning device 18 is arranged to be movable, preferably linearly, via at least one guidance system 19, preferably by means of the cleaning drive 21. The at least one support means 23; 24 is preferably configured in each case as at least one positioning aid 23 and/or as at least one cleaning aid 24.

The dimension of the at least one cleaning device 18 in the transverse direction A is preferably at least as great as the working width of the at least one nozzle bar 04 in the transverse direction A. The dimension of the at least one cleaning device 18 in the transport direction T of the printing substrate 03 is preferably at least as great as the working width of the at least one nozzle bar 04 in the transport direction T. This enables preferably all the exit surfaces 09 of all the print heads 08 of the at least one nozzle bar 04 to be cleaned in one operation. In an alternative embodiment, the dimension of the at least one cleaning device 18 in the transport direction T is at least as great as all the working widths of all the nozzle bars 04 of the printing unit 01 in the transport direction T combined. This enables all the exit surfaces 09 of all the print heads 08 of the at least one printing unit 01 to be cleaned in one operation.

The at least one cleaning unit 26 is preferably arranged to be movable along the cleaning guide 44, for example by means of the cleaning drive 21. The at least one cleaning unit 26 is further preferably arranged such that it is and/or can be moved in and/or counter to a cleaning direction G. The at least one collecting pan 22 is preferably arranged at least partially enclosing the at least one cleaning unit 26. The collecting pan 22 is further preferably arranged such that the collecting pan 22 at least partially encloses the cleaning unit 26 and the at least one print head 08 that is disposed in the maintenance position in the relevant nozzle bar 04.

The cleaning direction G is preferably a horizontal direction G in which a cleaning unit 26 can be moved, in particular to perform a cleaning step. The cleaning direction G preferably has at least one component that is aligned parallel to the transverse direction A and/or parallel to the y direction and is preferably oriented opposite the y direction. More preferably, the cleaning direction G is aligned parallel to the transverse direction A and/or parallel to the y direction and is preferably oriented opposite the y direction. The cleaning direction G is preferably oriented orthogonally to at least one transport direction T provided for the transport of at least one printing substrate 03 and/or orthogonally to the x direction. The at least one cleaning unit 26 and more preferably at least one cleaning element 31 is preferably arranged to be movable in and/or counter to the cleaning direction G. The at least one cleaning unit 26 is preferably arranged to be movable in and/or counter to the cleaning direction G. At least one cleaning element 31 is preferably arranged to be movable at least in the cleaning direction G during a cleaning operation for cleaning at least one exit surface 09 of at least one print head 08.

The at least one cleaning unit 26 preferably comprises at least one mounting element 28, preferably at least two mounting elements 28, and/or at least one force element 29 and/or at least one carrier 27 and/or the at least one cleaning element 31. Preferably, the at least one mounting element 28, preferably at least two mounting elements 28, and/or the at least one force element 29 and/or the at least one carrier 27 and/or the at least one cleaning element 31 are preferably fixedly connected to one another within the corresponding cleaning unit 26.

The at least one mounting element 28, in particular the at least two mounting elements 28, are preferably in direct contact with the at least one force element 29. The at least one force element 29 is configured, for example, as a bellows and/or hollow body and/or spring, and is preferably adjustable with respect to its extension and/or dimension in the z direction, preferably in a direction the main component of which corresponds to the z direction. The at least one carrier 27 is preferably configured as a base body and/or preferably carries the at least one mounting element 28, preferably at least two mounting elements 28, and/or the at least one force element 29 and/or the at least one cleaning element 31 of the corresponding cleaning unit 26. The at least one cleaning element 31 is preferably arranged in direct contact with at least one mounting element 28. The extension and/or dimension of the cleaning unit 26 in the z direction, more preferably in a direction the main component of which corresponds to the z direction, can preferably be adjusted and/or modified and/or moved by changing the extension and/or dimension of the at least one force element 29 of the cleaning unit 26 in question. As a result of this mobility, the at least one cleaning element 31 can preferably be brought into contact and/or out of contact with other components, such components including, in particular, the at least one print head 08 and/or the at least one support means 23; 24.

In a preferred embodiment, the at least one cleaning unit 26 comprises the at least one cleaning element 31, which is connected to the at least one carrier 27 via the at least one force element 29, preferably via at least four force elements 29, for example via precisely four force elements 29. The at least one force element 29, in particular each of the at least four force elements 29, is preferably in the form of a spring. The at least one cleaning element 31 is preferably mounted and/or attached in a floating manner in the at least one carrier 27, which is preferably configured as a base body, by means of the at least one force element 29. This preferably enables a precise and simple adjustment of the contact pressure exerted by the assigned nozzle bar 04 on the at least one cleaning element 31, in particular on at least one sliding surface 32 of the cleaning element 31, preferably as said nozzle bar is being lowered into the maintenance position and/or while it is disposed in the maintenance position.

The cleaning device 18 preferably has at least one positioning aid 23, which is different from every print head 08 and which preferably has at least one contact surface that is oriented in the same direction as the at least one bearing surface 11 and/or exit surface 09 of the at least one print head 08. The at least one contact surface of the positioning aid 23 preferably lies adjacent to or spaced apart from the at least one bearing surface 11 of a relevant print head 08 with respect to the cleaning direction G. The contact surface of the positioning aid 23 further preferably has a component in the z direction that is identical to that of the exit surface 09 of a print head 08 to be cleaned with the corresponding cleaning element 31. In particular, when there is direct contact between the at least one cleaning element 31 and the exit surface 09 of a print head 08 of the relevant nozzle bar 04, the contact surface of the positioning aid 23 is oriented in the same direction as the at least one exit surface 09. If direct contact is intended, for example, between the at least one cleaning element 31 and the exit surface 09 of a print head 08 of the relevant nozzle bar 04, then the cleaning element 31 is preferably configured as a contact element, for example as a wiper. If only indirect contact is provided, in particular, between the at least one cleaning element 31 and the exit surface 09 of a print head 08 of the relevant nozzle bar 04, the contact surface of the positioning aid 23 is oriented in the same direction as the at least one bearing surface 11, in particular the at least one spacer surface 11. The at least one positioning aid 23 is preferably situated such that the at least one cleaning element 31 can be positioned unambiguously in relation to at least one print head 08, in particular one print head to be cleaned.

The cleaning device 18 preferably comprises at least one cleaning aid 24. The cleaning aid 24 is preferably configured such that the at least one cleaning element 31 can be cleaned. The cleaning aid 24 preferably has at least one spray device and/or at least one wiping device.

The at least one cleaning element 31 is preferably configured as a cleaning head 31. The cleaning element 31 is preferably fixedly connected to the at least one mounting element 28 and/or to the at least one carrier 27 of the cleaning device 18 in question, in particular the cleaning unit 26 in question. The at least one cleaning element 31 is arranged to be movable in and/or counter to the cleaning direction G.

The cleaning head 31 has at least one fluid infeed 38 and at least one fluid removal opening 39; 41. The at least one fluid infeed 38 is further preferably configured as at least one fluid infeed 38 for the infeed of cleaning liquid. The at least one fluid removal opening 39; 41 is further preferably configured as at least one fluid removal opening 39; 41 for cleaning liquid and/or dirt. The cleaning head 31 has at least two fluid removal openings 39; 41, with each first fluid removal opening 39 preferably being configured as a fluid discharge 39 and/or with each second fluid removal opening 41 preferably being configured as a fluid extraction means 41. The at least one first fluid removal opening 39 preferably encompasses the at least one fluid infeed 38 at least partially, more preferably completely, in one plane.

When the cleaning head 31 is positioned in direct or indirect contact with the at least one print head 08, for example, at least one cleaning fluid, in particular a cleaning agent, can be delivered from the at least one fluid infeed 38, for example, in close proximity to the exit surface 09 of the at least one print head 08 and/or a positioning gap 07, and can be removed again by suction through the at least one fluid removal opening 39; 41, likewise in close proximity to the exit surface 09 of the at least one print head 08 and/or a positioning gap 07. For this purpose, the cleaning head 31 is preferably brought close enough to the at least one print head 08 that a cleaning gap is formed between the cleaning head 31, on one hand, and the exit surface 09 of the print head 08, on the other hand, through which the fluid, in particular the cleaning liquid, flows, thereby cleaning or enabling the cleaning of the exit surface 09 of the at least one print head 08 and/or a positioning gap 07.

The at least one cleaning head 31 preferably has at least one sliding point 32 provided in particular for contact with the at least one print head 08, the sliding point 32 preferably being configured as a sliding surface 32. The at least one sliding point 32 is preferably configured for at least partial contact with at least part of at least one bearing surface 11 of the at least one print head 08, which is more preferably configured as at least one spacer surface 11.

The at least one cleaning head 31 preferably has at least one ramp 33; 34. Further preferably, the cleaning head 31 has at least one first ramp 33 and at least one second ramp 34. Preferably, the at least one cleaning element 31 can be disposed in at least one first position and/or can be disposed in at least one second position, the first position of the cleaning element 31 being located at a distance from the second position of the cleaning element 31, preferably along the cleaning direction G.

The first ramp 33 is preferably configured as an approach ramp 33. The first ramp 33 is preferably disposed so as to decrease the distance between a reference point of the first ramp 33 and the print head 08 to be cleaned. The reference point of the first ramp 33 is preferably a point on the first ramp 33 that is disposed perpendicular to the print head 08 to be cleaned. In the first position of the cleaning element 31, the first ramp 33 preferably has a first distance at the reference point of the first ramp 33 from a print head 08 to be cleaned, preferably from at least one exit surface 09 and/or spacer surface 11 to be cleaned. In the second position of the cleaning element 31, the first ramp 33 preferably has a second distance at the reference point of the first ramp 33 from a print head 08 to be cleaned, preferably from at least one exit surface 09 and/or spacer surface 11 to be cleaned, the second distance between the reference point of the first ramp 33 and the print head 08 to be cleaned being shorter than the first distance between the reference point of the first ramp 33 and the print head 08 to be cleaned.

The second ramp 34 is preferably configured as a departure ramp 34. The second ramp 34 is preferably disposed so as to increase the distance between a reference point of the second ramp 34 and the print head 08 to be cleaned. The reference point of the second ramp 34 is preferably a point on the second ramp 34 that is disposed perpendicular to the print head 08 to be cleaned. In the first position of the cleaning element 31, the second ramp 34 preferably has a first distance at the reference point of the second ramp 34 from a print head 08, in particular to be cleaned, preferably from at least one exit surface 09 and/or spacer surface 11 to be cleaned. In the second position of the cleaning element 31, the second ramp 34 preferably has a second distance at the reference point of the second ramp 34 from a print head 08, in particular to be cleaned, preferably from at least one exit surface 09 and/or spacer surface 11 to be cleaned, the second distance between the reference point of the second ramp 34 and the print head 08 to be cleaned being greater than the first distance between the reference point of the second ramp 34 and the print head 08, in particular to be cleaned.

Alternatively or additionally, the at least one print head 08 and/or the at least one cleaning head 31 has at least one guide device 36. Said guide device 36 is preferably configured as a guide surface 36, the surface normal of which has at least one component that is orthogonal to the z direction and to the cleaning direction G. The at least one guide surface 36 of a cleaning head 31 preferably directly adjoins at least one sliding surface 32 of the respective cleaning head 31. The at least one guide device 36 is preferably arranged such that the cleaning head 31 can be and/or is positioned, within a tolerance range or in a precise position, with respect to a direction oriented parallel to the x direction and/or orthogonally to the cleaning direction G and orthogonally to the z direction.

The cleaning head 31 preferably has at least one cleaning region 37. The at least one cleaning region 37 preferably includes the at least one fluid infeed 38 and the at least one fluid removal opening 39; 41. Each cleaning region 37 further preferably includes the at least one fluid infeed 38 and/or the at least one fluid discharge 39 and/or the at least one fluid extraction means 41. Each at least one fluid removal opening 39; 41 is preferably connected to at least one sink for the removal of cleaning agent and/or dirt and/or particles, for example. The at least one fluid infeed 38 is preferably connected to a source of cleaning agent. The fluid infeed 38 within the cleaning region 37 is preferably configured as a fluid infeed opening 38. The at least one cleaning region 37 is preferably located between the at least one first ramp 33 and the at least one second ramp 34. In particular, the at least one first ramp 33 is located upstream of the at least one cleaning region 37 in the cleaning direction G. The at least one second ramp 34 is preferably located downstream of the at least one cleaning region 37 in the cleaning direction G. The first ramp 33 is preferably inclined upward from an outer edge of the cleaning element 31 toward the at least one cleaning region 37. The second ramp 33 is preferably inclined upward from an outer edge of the cleaning element 31 toward the at least one cleaning region 37. The slopes of the first ramp 33 and the second ramp 34 are preferably directed opposite one another.

The fluid infeed opening 38 preferably has at least one boundary of the fluid infeed opening 38 in a plane of the surface of the cleaning region 37, preferably orthogonally to the z direction, with a centroid. The boundary of the fluid infeed opening 38 further preferably has at least one first boundary point, which is positioned in alignment with the centroid with respect to the cleaning direction G. The boundary of the fluid infeed opening 38 preferably has at least one second boundary point, which is positioned in alignment with the centroid with respect to a direction orthogonal to the cleaning direction G. The boundary of the fluid infeed opening 38 preferably has at least one third boundary point, which is positioned on the boundary of the fluid infeed opening 38, in an extension of a line segment from the first boundary point to the centroid. The boundary of the fluid infeed opening 38 preferably has at least one fourth boundary point, which is positioned on the boundary of the fluid infeed opening 38 in an extension of a line segment from the second boundary point to the centroid. The first boundary point and the second boundary point and the third boundary point and the fourth boundary point are preferably each positioned at a distance greater than zero from one another on the boundary of the fluid infeed opening 38. The distance from the first boundary point to the third boundary point on the boundary of the fluid infeed opening 38 is preferably shorter than the distance from the second boundary point to the fourth boundary point on the boundary of the fluid infeed opening 38. A longitudinal direction of the fluid infeed opening 38 is preferably at least partially orthogonal to a straight line between the first boundary point and the geometric center of the boundary of the fluid infeed opening 38. In other words, for example, the at least one fluid infeed opening 38, in particular the boundary of the fluid infeed opening 38, preferably has the longitudinal direction of the fluid infeed opening 38 and a transverse direction of the fluid infeed opening 38 in the plane that is spanned by the x direction and the y direction, and/or orthogonally to the z direction. The dimensions of the fluid infeed opening 38 in its longitudinal direction and in its transverse direction are preferably different from one another. The fluid infeed opening 38, in particular the boundary of the fluid infeed opening 38, preferably has its maximum dimension in its longitudinal direction. The dimension of the fluid infeed opening 38, in particular the boundary of the fluid infeed opening 38, is preferably smaller in the transverse direction of the fluid infeed opening 38 than in its longitudinal direction.

In one exemplary embodiment, a cleaning region 37 has at least two fluid infeed openings 38, each having a boundary of the respective fluid infeed opening 38 in a plane of the surface of the cleaning region 37. The at least two fluid infeed openings 38 each have a centroid, the centroids of the fluid infeed openings 38 preferably being arranged on a straight line. The straight line of the at least two centroids of the fluid infeed openings 38 is preferably aligned at least partially orthogonally to the cleaning direction G and orthogonally to the z direction.

A tangent through the first boundary point of the boundary of the fluid infeed opening 38 is preferably disposed at least partially orthogonally to the cleaning direction G and orthogonally to the z direction. The tangent through the first boundary point of the boundary of the fluid infeed opening 38 preferably forms a plane angle of at least 50°, preferably of at least 60°, and of no more than 130°, preferably of no more than 120°, in a positive mathematical direction of rotation, i.e. in a counterclockwise rotation, with the cleaning direction G. The tangent through the first boundary point of the boundary of the fluid infeed opening 38 is preferably parallel to a plane that, at the position of the positioning gap 07, extends, for example, along the y direction displaced through the z direction and through at least one direction of the shortest boundary of a respective exit surface 09, which extends in a plane in the x direction and y direction, of the print head 08 to be cleaned in the relevant nozzle bar 04, which exit surface borders the positioning gap 07.

The tangent through the first boundary point of the boundary of the fluid infeed opening 38 is preferably parallel to a longitudinal direction of the fluid infeed opening 38, in particular in the case of a fluid infeed opening 38 that is elongated and/or oval and/or slot-shaped and/or configured as a groove and/or in another form as circular. The longitudinal direction of the fluid infeed opening 38 is aligned parallel to at least one positioning gap 07 of the associated nozzle bar 04. The longitudinal direction of the fluid infeed opening 38 is preferably located in a plane spanned by the x direction and the y direction. The fluid infeed opening 38 is preferably configured as a groove and/or elongated and/or oval and/or slot-shaped, preferably in the plane orthogonal to the z direction. A groove preferably has at least two longitudinal sides that are parallel to one another. The longitudinal direction of the fluid infeed opening 38 preferably forms a preferably plane angle, in particular an opening angle 47, of at least 50°, preferably of at least 60°, and of no more than 130°, preferably of no more than 120°, in a positive mathematical direction of rotation, i.e. rotated counterclockwise, with the cleaning direction G. In other words, this means, for example, that the inclination of the longitudinal direction of the at least one fluid infeed opening 38 is identical to that of the longitudinal direction of the at least one positioning gap 07, preferably around the opening angle 47 in relation to the cleaning direction G. The opening angle 47 thus preferably corresponds, in particular, to the at least partial diagonal overlap in the x direction of the at least two print heads 08 arranged side by side, in particular adjacent to one another. From this it is clear, for example, that the opening angle 47 is preferably an acute angle or an obtuse angle. This acute or obtuse configuration of the opening angle 47 preferably mirrors the at least partial diagonal overlap in the x direction of the at least two print heads 08 arranged side by side and/or the alignment of the longitudinal direction of the at least one positioning gap 07. The fluid infeed opening 38 is aligned parallel to at least one positioning gap 07 of the associated nozzle bar 04. Further preferably, the fluid infeed opening 38 is preferably aligned parallel to the at least one positioning gap 07 between at least two print heads 08, in particular to be cleaned, preferably within a row in the y direction of a nozzle bar 04. More preferably, the tangent through the first boundary point of the boundary of the fluid infeed opening 38 is aligned parallel to at least one positioning gap 07 of the associated nozzle bar 04. This enables an optimal penetration of cleaning agent into the positioning gap 07, for example.

The fluid discharge 39 is preferably arranged at least partially surrounding the fluid infeed opening 38 in at least one plane. More preferably, the fluid discharge 39 is arranged completely surrounding the fluid infeed opening 38 in at least one plane. Said plane is preferably spanned by the x direction and the y direction. The fluid discharge 39 is preferably configured, for example, to discharge and/or be capable of discharging cleaning agent and/or dirt and/or particles that adhere to or are left behind on the respective exit surface 09 and/or the respective bearing surface 11 of a relevant print head 08, for example.

The fluid discharge 39 preferably has at least one boundary of the fluid discharge 39 in a plane of the surface of the cleaning region 37, preferably orthogonally to the z direction, with a centroid. The boundary of the fluid discharge 39 further preferably has at least one fifth boundary point, which is positioned in alignment with the centroid of the boundary of the fluid discharge 39 with respect to the cleaning direction G. The boundary of the fluid discharge 39 preferably has at least one sixth boundary point, which is positioned in alignment with the centroid with respect to a direction orthogonal to the cleaning direction G. The boundary of the fluid discharge 39 preferably has at least one seventh boundary point, which is positioned on the boundary of the fluid discharge 39 in an extension of a line segment from the fifth boundary point to the centroid. The boundary of the fluid discharge 39 preferably has at least one eighth boundary point, which is positioned on the boundary of the fluid discharge 39 in an extension of a line segment from the sixth boundary point to the centroid. The fifth boundary point and the sixth boundary point and the seventh boundary point and the eighth boundary point are preferably each positioned at a distance greater than zero from one another on the boundary of the fluid discharge 39. The distance from the fifth boundary point to the seventh boundary point on the boundary of the fluid discharge 39 is preferably shorter than the distance from the sixth boundary point to the eighth boundary point on the boundary of the fluid discharge 39. A longitudinal direction of the fluid discharge 39 is preferably at least partially orthogonal to a straight line between the fifth boundary point and the geometric center of the boundary of the fluid discharge 39. In other words, for example, the at least one fluid discharge 39, in particular the boundary of the fluid discharge 39, preferably has the longitudinal direction of the fluid discharge 39 and a transverse direction of the fluid discharge 39 in the plane that is spanned by the x direction and the y direction, and/or orthogonally to the z direction. The dimensions of the fluid discharge 39 in its longitudinal direction and in its transverse direction are preferably different from one another. The fluid discharge 39, in particular the boundary of the fluid discharge 39, preferably has its maximum dimension in its longitudinal direction. The dimension of the fluid discharge 39, in particular the boundary of the fluid discharge 39, is preferably smaller in the transverse direction of the fluid discharge 39 than in its longitudinal direction.

A tangent through the fifth boundary point of the boundary of the fluid discharge 39 is further preferably at least partially orthogonal to the cleaning direction G and orthogonal to the z direction, and additionally or alternatively parallel to the corresponding tangent through the first boundary point of the boundary of the respective fluid infeed opening 38. Additionally or alternatively, the fluid discharge 39 is preferably aligned at least partially orthogonally to the cleaning direction G and orthogonally to the z direction and/or parallel to at least one positioning gap 07 of the associated nozzle bar 04. The tangent through the fifth boundary point of the boundary of the fluid discharge 39 is preferably aligned parallel to the at least one positioning gap 07 of the associated nozzle bar 04, in particular in a plane of the surface of the cleaning region 37. The tangent through the fifth boundary point of the boundary of the fluid discharge 39, which is disposed at least partially orthogonally to the cleaning direction G and orthogonally to the z direction, preferably forms a plane angle of at least 50°, preferably of at least 60°, and of no more than 130°, preferably of no more than 120°, in a positive mathematical direction of rotation, i.e. rotated counterclockwise, with the cleaning direction G.

The tangent through the fifth boundary point of the boundary of the fluid discharge 39 is preferably parallel to a longitudinal direction of the fluid discharge 39, in particular in the case of a fluid discharge 39 that is elongated and/or oval and/or slot-shaped and/or configured as a groove and/or as trapezoidal and/or in another form as circular. The fluid discharge 39 is preferably configured as trapezoidal and/or groove-shaped and/or as a parallelogram, preferably in the plane orthogonal to the z direction. The longitudinal direction of the fluid discharge 39 is aligned parallel to at least one positioning gap 07 of the associated nozzle bar 04. Preferably, the longitudinal direction of the fluid discharge 39 forms a preferably plane angle, in particular a discharge angle 48, of at least 50°, preferably of at least 60°, and of no more than 130°, preferably of no more than 120°, in a positive mathematical direction of rotation, i.e. rotated counterclockwise, with the cleaning direction G. In other words, this means, for example, that the inclination of the longitudinal direction of the at least one fluid discharge 39 is identical to that of the longitudinal direction of the at least one positioning gap 07, preferably around the discharge angle 48 in relation to the cleaning direction G. The discharge angle 48 thus corresponds, in particular, to the at least partial diagonal overlap in the x direction of the at least two print heads 08 arranged side by side, in particular adjacent to one another. From this it is clear, for example, that the discharge angle 48 is preferably an acute angle or an obtuse angle. This acute or obtuse configuration of the discharge angle 48 preferably mirrors the at least partial diagonal overlap in the x direction of the at least two print heads 08 arranged side by side and/or the alignment of the longitudinal direction of the at least one positioning gap 07.

A strong vacuum can be applied to the at least one fluid extraction means 41, for example. The fluid extraction means 41 is preferably configured to remove at least such cleaning fluid and/or such dirt as remains following at least one removal by suction by means of the at least one fluid discharge 39.

The at least one fluid extraction means 41 is preferably configured as a relatively narrow slot. The fluid extraction means 41 preferably has at least one boundary of the fluid extraction means 41 in a plane of the surface of the cleaning region 37, preferably orthogonally to the z direction, with a centroid. The boundary of the fluid extraction means 41 further preferably has at least one ninth boundary point, which is positioned in alignment with the centroid of the boundary of the fluid extraction means 41 with respect to the cleaning direction G. The boundary of the fluid extraction means 41 preferably has at least one tenth boundary point, which is positioned in alignment with the centroid with respect to a direction orthogonal to the cleaning direction G. The boundary of the fluid extraction means 41 preferably has at least one eleventh boundary point, which is positioned on the boundary of the fluid extraction means 41 in an extension of a line segment from the ninth boundary point to the centroid. The boundary of the fluid extraction means 41 preferably has at least one twelfth boundary point, which is positioned on the boundary of the fluid extraction means 41 in an extension of a line segment from the tenth boundary point to the centroid. The ninth boundary point and the tenth boundary point and the eleventh boundary point and the twelfth boundary point are preferably each positioned at a distance greater than zero from one another on the boundary of the fluid extraction means 41. The distance from the ninth boundary point to the eleventh boundary point on the boundary of the fluid extraction means 41 is preferably shorter than the distance from the tenth boundary point to the twelfth boundary point on the boundary of the fluid extraction means 41. A longitudinal direction of the fluid extraction means 41 is preferably at least partially orthogonal to a straight line between the ninth boundary point and the geometric center of the boundary of the fluid extraction means 41. In other words, for example, the at least one fluid extraction means 41, in particular the boundary of the fluid extraction means 41, preferably has the longitudinal direction of the fluid extraction means 41 and a transverse direction of the fluid extraction means 41 in the plane that is spanned by the x direction and the y direction, and/or orthogonally to the z direction. The dimensions of the fluid extraction means 41 in its longitudinal direction and in its transverse direction are preferably different from one another. The fluid extraction means 41, in particular the boundary of the fluid extraction means 41, preferably has its maximum dimension in its longitudinal direction. The dimension of the fluid extraction means 41, in particular the boundary of the fluid extraction means 41, is preferably smaller in the transverse direction of the fluid extraction means 41 than in its longitudinal direction. The dimension of the at least one fluid extraction means 41 is preferably at least five times as great, more preferably at least ten times as great, more preferably at least fifteen times as great, more preferably at least twenty times as great in its longitudinal direction as in its transverse direction.

The minimum distance from the ninth boundary point to the eleventh boundary point of the fluid extraction means 41 is preferably shorter than the minimum distance from the fifth boundary point to the seventh boundary point of the fluid discharge 39, with the distance preferably being no more than half as great, more preferably no more than one-fifth as great. Thus, the dimension of the at least one fluid extraction means 41 in its transverse direction is preferably smaller, for example, than the dimension of the at least one fluid discharge 39 in its transverse direction, with the dimension of the at least one fluid extraction means 41 being no more than half as great, more preferably no more than one-fifth as great as the dimension of the at least one fluid discharge 39 in its transverse direction.

The boundary of the fluid extraction means 41 preferably has at least two boundary points that have the greatest possible distance from one another of all boundary points of the boundary of the fluid extraction means 41. The greatest possible distance between two boundary points of the boundary of the fluid extraction means 41 preferably has a minimum length of preferably at least 35 mm (millimeters), in particular of at least 40 mm, more preferably of at least 45 mm, and/or a maximum length of preferably no more than 60 mm, in particular of no more than 55 mm, more preferably of no more than 50 mm. The greatest possible distance between two boundary points of the boundary of the fluid extraction means 41 further preferably has a minimum length that is greater than at least one boundary of a relevant exit surface 09, in particular to be cleaned, of a relevant print head 08 in a direction that is oriented parallel to the minimum length of the fluid extraction means 41. The greatest possible distance between two boundary points of the boundary of the fluid extraction means 41 further preferably has a minimum length that is greater than at least one boundary of a relevant exit surface 09, in particular to be cleaned, of a relevant print head 08 in the x direction.

A tangential line through the ninth boundary point of the boundary of the fluid extraction means 41 is preferably positioned at least partially orthogonally to the cleaning direction G and orthogonal to the z direction, and alternatively or additionally is positioned parallel to the corresponding tangential line through the first boundary point of the boundary of the fluid infeed opening 38. Additionally or alternatively, the fluid extraction means 41 is preferably positioned at least partially orthogonally to the cleaning direction G and orthogonally to the z direction and parallel to the positioning gap 07. The tangent through the ninth boundary point of the boundary of the fluid extraction means 41 is preferably aligned parallel to the at least one positioning gap 07 of the associated nozzle bar 04, in particular in a plane of the surface of the cleaning region 37. The tangent through the ninth boundary point of the boundary of the fluid extraction means 41, which is disposed at least partially orthogonally to the cleaning direction G and orthogonally to the z direction, preferably forms a plane angle of at least 50°, preferably of at least 60°, and of no more than 130°, preferably of no more than 120°, in a positive mathematical direction of rotation, i.e. rotated counterclockwise, with the cleaning direction G.

The tangent through the ninth boundary point of the boundary of the fluid extraction means 41 is preferably parallel to a longitudinal direction of the fluid extraction means 41.

The longitudinal direction of the fluid extraction means 41 is aligned parallel to the at least one positioning gap 07 of the associated nozzle bar 04. Preferably, the longitudinal direction of the fluid extraction means 41 forms a preferably plane angle, in particular an extraction angle 49, of at least 50°, preferably of at least 60°, and of no more than 130°, preferably of no more than 120°, in a positive mathematical direction of rotation, i.e. rotated counterclockwise, with the cleaning direction G. In other words, this means, for example, that the inclination of the longitudinal direction of the at least one fluid extraction means 41 is identical to that of the longitudinal direction of the at least one positioning gap 07, preferably around the extraction angle 49 in relation to the cleaning direction G. The extraction angle 49 thus preferably corresponds, in particular, to the at least partial diagonal overlap in the x direction of the at least two print heads 08 arranged side by side, in particular adjacent to one another. From this it is clear, for example, that the extraction angle 49 is preferably an acute angle or an obtuse angle. This acute or obtuse configuration of the extraction angle 49 preferably mirrors the at least partial diagonal overlap in the x direction of the at least two print heads 08 arranged side by side and/or the alignment of the longitudinal direction of the at least one positioning gap 07.

In a preferred embodiment, the tangent through the first boundary point of the boundary of the fluid infeed opening 38 and/or the tangent through the fifth boundary point of the boundary of the fluid discharge 39 and/or the tangent through the ninth boundary point of the boundary of the fluid extraction means 41 preferably forms a plane angle of at least 50°, preferably of at least 60°, and of no more than 130°, preferably of no more than 120°, in a positive mathematical direction of rotation, with the cleaning direction G. More preferably, the longitudinal direction of the fluid infeed opening 38 and/or the longitudinal direction of the fluid discharge 39 and/or the longitudinal direction of the fluid extraction means 41 each form a plane angle of at least 50°, preferably of at least 60°, and of no more than 130°, preferably of no more than 120°, in a positive mathematical direction of rotation, with the cleaning direction G.

In a preferred exemplary embodiment, each relevant cleaning element 31 comprises at least one cleaning region 37, by means of which preferably at least one print head 08 of at least one nozzle bar 04 is and/or can be cleaned. In an alternative exemplary embodiment, the relevant cleaning element 31 preferably comprises at least two cleaning regions 37. Said at least two cleaning regions 37 preferably are and/or can be connected by at least one connecting element 42. Thus, by means of the one relevant cleaning head 31, which comprises at least two connectable and/or connected cleaning regions 37, at least two print heads 08 preferably are and/or can be cleaned, the at least two print heads 08 preferably being arranged in at least two different rows of print heads 08 in the y direction. Additionally or alternatively to the at least one cleaning region 37, a cleaning head 31 comprises, for example, at least one wiper 52, which is arranged, for example, in direct contact with at least one exit surface 09 of a print head 08 to be cleaned.

In a preferred embodiment, the at least one printing unit 01 of the printing press comprises at least one nozzle bar 04 having at least two print heads 08 arranged side by side, which delimit the at least one positioning gap 07, with at least one feed device 13 assigned to the respective positioning gap 07 and/or at least one cleaning device 18 assigned to the relevant print head 08 of the nozzle bar 04.

The at least one feed device 13 is used in an operating mode of the printing press, for example, in which at least one printing substrate 03 can be and/or is printed with at least one printing fluid. The ejection of at least one fluid, for example a gas and/or a gas mixture, in particular air, and/or a liquid, through the outlet opening 17 of the respective feed device 13 preferably impedes and/or prevents the penetration and/or deposition of printing fluid into the respective positioning gap 07.

In at least one cleaning operation, at least the at least one cleaning element 31 and/or the at least one cleaning unit 26 is preferably moved, preferably in the cleaning direction G. The relevant cleaning element 31 and/or the relevant cleaning unit 26 has a constant speed along the cleaning direction G, for example. The fluid infeed opening 38 preferably ejects cleaning agent, which comes into contact with the at least one exit surface 09 and/or the at least one bearing surface 11 and/or the at least one positioning gap 07 of the relevant nozzle bar 04. The cleaning agent preferably cleans the at least one exit surface 09 and/or the at least one bearing surface 11 and/or the at least one positioning gap 07. Following the cleaning of the exit surface 09 and/or the bearing surface 11 and/or the positioning gap 07, for example, the fluid discharge 39 removes the cleaning agent and/or dirt by suction, for example, in a preferably first removal step, preferably by the application of a vacuum. In a second removal step, the fluid extraction means 41 preferably removes by suction the cleaning agent and/or dirt, for example, that remains on and/or adheres to the exit surface 09 and/or the bearing surface 11 and/or in the positioning gap 07, for example following the first removal step.

Alternatively or additionally, the speed of the cleaning element 31 and/or the cleaning unit 26 in the cleaning direction G can preferably be slowed and/or said cleaning element and/or cleaning unit can be halted preferably in at least one position, which is assigned to a positioning gap 07, for example, allowing a cleaning of the relevant positioning gap 07 to be carried out, for example. During the at least one cleaning operation, the at least one feed device 13 preferably ejects a fluid, for example a gas and/or a gas mixture, in particular air, and/or a liquid, through the at least one outlet opening 17. A penetration and/or deposition of the cleaning agent into the respective positioning gap 07 is thus impeded and/or prevented during the cleaning operation.

An intensive cleaning of the at least one relevant positioning gap 07 is preferably carried out, for example, in which the speed of the cleaning element 31 and/or the cleaning unit 26 in the cleaning direction G is slowed, and/or said cleaning element and/or cleaning unit is halted, preferably at the at least one position that is preferably assigned to the respective positioning gap 07, and/or the feed device 13 ejects at least one fluid, for example a gas and/or a gas mixture, in particular air, and/or a liquid.

In a preferred embodiment of the cleaning element 31, the at least one cleaning element 31 has at least two sliding surfaces 32, which are arranged one behind the other in the cleaning direction G, preferably in alignment with one another. The at least two sliding surfaces 32 are spaced apart from one another by a distance greater than zero, for example. Downstream of the at least one cleaning region 37, in particular downstream of the at least one fluid extraction means 41, and/or upstream of the at least one second ramp 34 in the cleaning direction G, in particular, at least one edge 51 is arranged. The at least one cleaning region 37 is preferably raised in the z direction in relation to a surface of the cleaning element 31 downstream of the at least one edge 51, in particular in the z direction in relation to the at least one second ramp 34. The distance between the cleaning element 31, preferably immediately downstream of the cleaning region 37, in particular downstream of the at least one fluid extraction means 41, and the at least one exit surface 09 of the at least one print head 08 is thereby increased. The at least one edge 51 prevents, in particular, the smearing of any printing fluid located on the at least one exit surface 09 at that point in time, preferably when the at least one cleaning element 31 is passing the exit surface 09 in question. At least one of the at least two sliding surfaces 32 arranged one behind the other in the cleaning direction G is preferably located downstream of the at least one cleaning region 37 in the cleaning direction G, in particular at the at least one second ramp 34. This ensures optimal guidance of the cleaning element 31 in the region downstream of the at least one cleaning region 37, so that a distance greater than zero of the at least one surface of the cleaning element 31 and/or the at least one second ramp 34 from the at least one exit surface 09, in particular in the z direction, is guaranteed. During a positioning of the at least one cleaning element 31 on the at least one print head 08, or vice versa, and/or during a movement of the cleaning element 31 in or counter to the cleaning direction G, the at least one sliding surface 32, preferably all sliding surfaces 32, is/are preferably arranged upstream or downstream of the at least one exit surface 09, orthogonally to the cleaning direction G, for example at a distance from the at least one exit surface 09 orthogonally to the cleaning direction G, i.e. preferably to the side. The at least one sliding surface 32 preferably has a greater dimension in the cleaning direction G than orthogonally to the cleaning direction G.

In a preferred embodiment of the at least one cleaning element 31, the cleaning element 31 has at least two cleaning regions 37, preferably four cleaning regions 37. The at least one cleaning element 31 preferably has precisely as many cleaning regions 37 as the number of rows of print heads, in particular arranged side by side in the x direction, of the nozzle bar 04 assigned to said cleaning element 31. The at least two cleaning regions 37 are preferably arranged side by side orthogonally to the cleaning direction G and/or orthogonally to the y direction and/or in the x direction. Thus, at least two rows of print heads 08, preferably four rows of print heads 08, more preferably all rows of print heads 08 of a nozzle bar 04 preferably are cleaned and/or can be cleaned at the same time and/or with the at least one cleaning element 31.

In each case, for example, the at least one cleaning element 31, preferably if it comprises at least two cleaning regions 37, has at least one sliding surface 32 upstream of a first cleaning region 37 in the x direction and/or downstream of a last cleaning region 37 in the x direction. The at least one cleaning element 31 preferably has no additional sliding surface 32 between its first and its last cleaning region 37. Additionally or alternatively, for example, each at least one cleaning element 31, preferably if it comprises at least two cleaning regions 37, has at least one guide surface 36 upstream of a first cleaning region 37 in the x direction and/or downstream of a last cleaning region 37 in the x direction. The at least one cleaning element 31 preferably has no additional guide surface 36 between its first and its last cleaning region 37.

In a preferred embodiment, the at least one nozzle bar 04 comprises at least two rows of print heads 08. The at least two rows of print heads 08 are preferably each arranged at an angle of at least 1° (one degree), preferably of at least 3°, more preferably of 4°, to one another. This is the case, in particular, when a curved and/or cylindrical printing substrate guide element 02 is positioned opposite the at least one nozzle bar 04. In each case, the at least two rows of print heads 08 are preferably arranged at an angle of at least 1° (one degree), preferably of at least 3°, more preferably of 4°, to one another with respect to a normal vector of the respective exit surfaces 09.

A surface of each cleaning element 31, which comprises the at least one fluid infeed 38 and the at least one fluid discharge 39 and the at least one fluid extraction means 41, preferably the plane of the surface of the respective cleaning region 37, is preferably parallel to the at least one exit surface 09 of the at least one print head 08 to which said surface and/or said cleaning region 37 is assigned. Said surface and/or said cleaning region 37 is more preferably directed toward said at least one exit surface 09. The normal vectors of at least two surfaces of the cleaning element 31, each of which comprises at least one fluid infeed 38 and at least one fluid discharge 39 and at least one fluid extraction means 41, preferably the surfaces of the at least two cleaning regions 37 of the cleaning element 31, preferably form an angle of at least 1° (one degree), preferably of at least 3°, more preferably of 4° to one another.

At least one flow controller is preferably arranged in the fluid infeed 38, in particular in a channel of the fluid infeed 38. The at least one flow controller is preferably configured to regulate the supply of cleaning agent to the at least one fluid infeed opening 38, in particular based on the angular position and/or the inclination of the respective cleaning region 37.

Additionally or alternatively, for example, the at least two cleaning regions 37 of a cleaning element 31 are arranged offset from one another in the cleaning direction G. As a result, they preferably mirror the offset of the existing rows of print heads 08 from one another.

The at least one cleaning element 31 preferably additionally has the at least one wiper 52 downstream of the at least one cleaning region 37 in the cleaning direction G. The at least one wiper 52 is preferably configured as a wiper lip, for example made of rubber. The at least one wiper 52 preferably extends in the x direction over the entire length of the exit surface 09 of the at least one associated print head 08 in this direction.

While preferred embodiments of a printing press, in accordance with the present invention, have been set forth fully and completely hereinabove, it will be apparent to one of skill in the art that various changes could be made thereto, without departing from the true spirit and scope of the present invention, which is accordingly to be limited only by the appended claims.

The invention claimed is:

1. A printing press comprising at least one printing unit (01) having at least one nozzle bar (04) with at least two print heads (08) and at least one cleaning device (18), wherein the at least one nozzle bar (04) is assigned to the at least one cleaning device (18), wherein the at least one cleaning device (18) comprises at least one cleaning element (31), wherein the at least one cleaning element (31) is arranged so as to be movable in and counter to a cleaning direction (G), wherein the at least one cleaning element (31) has at least one fluid infeed opening (38) and at least one fluid discharge (39) and at least one fluid extraction means (41), wherein a y direction and an x direction and a z direction form a Cartesian system of coordinates, wherein the y direction corresponds to a direction along at least one longest side of the respective at least one nozzle bar (04), wherein the x direction corresponds to a direction along at least one shortest side of the respective at least one nozzle bar (04), wherein the z direction is parallel to a normal vector of a plane that is spanned by the x direction and the y direction, wherein the at least two print heads (08) are arranged side by side, wherein the at least two print heads (08) arranged side by side are arranged spaced apart from one another by at least one positioning gap (07), wherein the cleaning direction (G) and the y direction form a plane angle of at least 50° and of no more than 130°, in a positive mathematical direction of rotation, with a longitudinal direction of the positioning gap (07), characterized in that a longitudinal direction of the at least one fluid infeed opening (38) is aligned parallel to the at least one positioning gap (07) of the assigned nozzle bar (04), and/or in that a longitudinal direction of the at least one fluid discharge (39) is aligned parallel to the at least one positioning gap (07) of the assigned at least one nozzle bar (04).

2. The printing press according to claim 1, characterized in that the at least one fluid extraction means (41) has at least one boundary having at least two boundary points and in that at least one print head (08) of the at least two print heads (08) comprises at least one exit surface (09), wherein the greatest possible distance between two boundary points of the boundary of the at least one fluid extraction means (41) has a minimum length that is greater than a boundary of the at least one relevant exit surface (09) of the at least one relevant print head (08) in a direction that is oriented parallel to the minimum length of the at least one fluid extraction means (41).

3. The printing press according to claim 2, characterized in that a greatest possible distance between the two boundary points of the at least one boundary of the at least one fluid extraction means (41) has a minimum length of at least 35 mm (millimeters) and a maximum length of no more than 60 mm.

4. The printing press according to claim 1, characterized in that the longitudinal direction of the at least one fluid infeed opening (38) and the longitudinal direction of the at least one fluid discharge (39) and the longitudinal direction of the at least one fluid extraction means (41) each form a plane angle of at least 50° and of no more than 130°, in a positive mathematical direction of rotation, to the cleaning direction (G).

5. The printing press according to claim 1, characterized in that the at least one fluid extraction means (41) has a longitudinal direction of the at least one fluid extraction means (41) and a transverse direction of the at least one fluid extraction means (41) in a plane that is spanned by the x direction and the y direction, and orthogonally to the z direction, in that the dimensions of the at least one fluid extraction means (41) in its longitudinal direction and in its transverse direction are different from one another, in that the maximum dimension of the fluid extraction means (41) is in its longitudinal direction, and in that the dimension of the at least one fluid extraction means (41) in its longitudinal direction is at least five times as great as in its transverse direction.

6. The printing press according to claim 1, characterized in that the print heads (08) of the at least one nozzle bar (04) are each arranged at least partially overlapping diagonally in the x direction.

7. The printing press according to claim 1, characterized in that the at least one fluid discharge (39) is arranged at least partially encompassing the at least one fluid infeed opening (38) in at least one plane.

8. The printing press according to claim 1, characterized in that the at least one cleaning element (31) has at least one first ramp (33) and has at least one second ramp (34), in that the at least one first ramp (33) is disposed so as to decrease a distance between a reference point on the at least one first ramp (33) and a first print head (08) of the at least two print heads (08) that is to be cleaned, and in that the at least one second ramp (34) is disposed so as to increase a distance between a reference point on the at least one second ramp (34) and the first print head (08) of the at least two print heads (08) that is to be cleaned.

9. The printing press according to claim 1, characterized in that the at least one cleaning element (31) has at least a first sliding surface (32).

10. The printing press according to claim 9, characterized in that the at least one cleaning element (31) has at least the first sliding surface and has a second sliding surface (32), which first and second sliding surfaces are arranged one behind the other in the cleaning direction (G), and in that the at least one fluid infeed opening (38) is configured to ejecta cleaning agent, which cleaning agent is intended to come into contact with at least one exit surface (09) of at least one print head (08) of the at least two print heads 08, and at least one bearing surface (11) of the at least one print head (08) of the at least two print heads (08), and in that at least part of the at least one bearing surface (11) of the at least one print head (08) of the at least two print heads (08) is configured for at least partial contact with the at least one sliding surface (32).

11. The printing press according to claim 10, characterized in that the at least one fluid discharge (39) is configured to remove the cleaning agent and dirt by suction in a first removal step, in that the at least one fluid extraction means (41) is configured to remove, by suction, the cleaning agent and dirt that remains and is left adhering to the at least one exit surface (09) and to the at least one bearing surface (11) and in the at least one positioning gap (07), in a second removal step.

12. The printing press according to claim 1, characterized in that the at least two print heads (08) are arranged side by side, in that the at least two print heads (08) arranged side by side are arranged spaced apart from one another by at least one positioning gap (07), and in that the at least one fluid infeed opening (38) is configured to eject a cleaning agent, which cleaning agent is intended to come into contact with the at least one positioning gap (07) of the relevant at least one nozzle bar (04).

13. The printing press according to claim 1, characterized in that the at least two print heads (08) are arranged side by side, in that the at least two print heads (08) arranged side by side are arranged spaced apart from one another by at least one positioning gap (07), in that the respective at least one positioning gap (07) is assigned at least one feed device (13) for ejecting a fluid in an outlet direction (L), and wherein at least one component of the outlet direction (L) is directed toward the respective at least one positioning gap (07).

14. The printing press according to claim 13, characterized in that the at least one feed device (13) is positioned such that the outlet direction (L) is directed from one side of the at least one print head (08) of the at least two print heads (08) toward the at least one positioning gap (07), where the at least one print head (08) is attached to the corresponding at least one nozzle bar (04), and in that the at least one feed device (13) comprises at least one outlet opening (17), wherein the at least one outlet opening (17) extends in a plane that is spanned by the z direction and at least one direction of a shortest boundary, which extends in a plane in the x direction and y direction, of a respective at least one exit surface (09) of the relevant at least one print head (08), wherein the respective at least one exit surface (09) borders the at least one positioning gap (07), and is configured such that the at least one outlet opening (17) has a smaller dimension in the z direction, remote from the respective at least one exit surface (09), than in the z direction near the at least one exit surface (09).

15. The printing press according to claim 13, characterized in that the dimension of the at least one feed device (13) in the y direction is identical to the dimension of the respective at least one positioning gap (07) in the y direction, and in that the at least one feed device (13) is connected to at least one print head (08) of the at least two print heads (08) that delimit the respective at least one positioning gap (07), and in that the at least one feed device (13) is positioned in the z direction on a side of the at least one exit surface (09) that faces away from at least one opening of the respective at least one exit surface (09).

16. The printing press of claim 1 wherein a longitudinal direction of the at least one fluid discharge (39) is aligned parallel to the at least one positioning gap (07) of the assigned at least one nozzle bar (04).

17. The printing press of claim 1 wherein a longitudinal direction of the at least one fluid extraction means (41) is aligned parallel to the at least one positioning gap (07) of the assigned at least one nozzle bar (04).

18. A printing press comprising at least one printing unit (01) having at least one nozzle bar (04) with at least two print heads (08) and at least one cleaning device (18), wherein the at least one nozzle bar (04) is assigned to the at least one cleaning device (18), wherein the at least one cleaning device (18) comprises at least one cleaning element (31), wherein the at least one cleaning element (31) is arranged so as to be movable in and counter to a cleaning direction (G), wherein the at least one cleaning element (31) has at least one fluid infeed opening (38) and at least one fluid discharge (39) and at least one fluid extraction means (41), wherein a y direction and an x direction and a z direction form a Cartesian system of coordinates, wherein the y direction corresponds to a direction along at least one longest side of the respective at least one nozzle bar (04), wherein the x direction corresponds to a direction along at least one shortest side of the respective at least one nozzle bar (04), wherein the z direction is parallel to a normal vector of a plane that is spanned by the x direction and the y direction, wherein the at least two print heads (08) are arranged side by side, wherein the at least two print heads (08) arranged side by side are arranged spaced apart from one another by at least one positioning gap (07), wherein the cleaning direction (G) and the y direction forms form a plane angle of at least 50° and of no more than 130°, in a positive mathematical direction of rotation, with a longitudinal direction of the positioning gap (07), characterized in that a longitudinal direction of the at least one fluid extraction means (41) is aligned parallel to the at least one positioning gap (07) of the assigned at least one nozzle bar (04).

19. The printing press of claim 18 wherein a longitudinal direction of the at least one fluid discharge (39) is aligned parallel to the at least one positioning gap (07) of the assigned at least one nozzle bar (04).

20. The printing press of the claim 18 wherein the at least one fluid extraction means (41) has at least one boundary layer having at least two boundary points and in that the at least one print head (08) of the at least two print heads (08) comprises at least one exit surface (09), wherein a greatest possible distance between two boundary points of a boundary of the at least one fluid extraction means (41) has a minimum length that is greater than a boundary of the at least one relevant exit surface (09) of the at least one relevant print head (08) in a direction that is oriented parallel to the minimum length of the at least one fluid extraction means.

21. A printing press comprising at least one printing unit (01) having at least one nozzle bar (04) with at least two print heads (08) and at least one cleaning device (18), wherein the at least one nozzle bar (04) is assigned to the at least one cleaning device (18), wherein the at least one cleaning device (18) comprises at least one cleaning element (31), wherein the at least one cleaning element (31) is arranged so as to be movable in and counter to a cleaning direction (G), wherein the at least one cleaning element (31) has at least one fluid infeed opening (38) and at least one fluid discharge (39) and at least one fluid extraction means (41), wherein a y direction and an x direction and a z direction form a Cartesian system of coordinates, wherein the y direction corresponds to a direction along at least one longest side of the respective at least one nozzle bar (04), wherein the x direction corresponds to a direction along at least one shortest side of the respective at least one nozzle bar (04), wherein the z direction is parallel to a normal vector of a plane that is spanned by the x direction and the y direction, wherein the at least two print heads (08) are arranged side by side, wherein the at least two print heads (08) arranged side by side are arranged spaced apart from one another by at least one positioning gap (07), wherein the cleaning direction (G) and the y direction forms a plane angle of at least 50° and of no more than 130°, in a positive mathematical direction of rotation, with a longitudinal direction of the positioning gap (07), characterized in that a longitudinal direction of the at least one fluid discharge (39) is aligned parallel to the at least one positioning gap (07) of the assigned at least one nozzle bar (04).

22. The printing press according to claim 21 wherein the at least one fluid discharge (39) is arranged at least partially encompassing the fluid discharge opening (38) in at least one plane.

* * * * *